US008588632B2

(12) United States Patent
Ohshima et al.

(10) Patent No.: US 8,588,632 B2
(45) Date of Patent: Nov. 19, 2013

(54) INFORMATION PROCESSOR, IMAGE FORMING APPARATUS, INFORMATION PROCESSING METHOD, AND NON-TRANSITORY COMPUTER-READABLE MEDIUM

(75) Inventors: Minoru Ohshima, Kanagawa (JP); Yoshinari Iwaki, Kanagawa (JP); Seigo Makida, Kanagawa (JP); Takashi Ogino, Kanagawa (JP); Takao Furuya, Kanagawa (JP); Kiyoshi Hosoi, Kanagawa (JP); Katsumi Sakamaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 308 days.

(21) Appl. No.: 13/209,797

(22) Filed: Aug. 15, 2011

(65) Prior Publication Data

US 2012/0237231 A1 Sep. 20, 2012

(30) Foreign Application Priority Data

Mar. 16, 2011 (JP) ..... 2011-058118

(51) Int. Cl.
*G03G 15/23* (2006.01)
*G03G 21/20* (2006.01)

(52) U.S. Cl.
USPC ..... 399/45; 399/44; 399/364

(58) Field of Classification Search
USPC ..... 399/44, 45, 254, 364
See application file for complete search history.

(56) References Cited

U.S. PATENT DOCUMENTS

| | | | | |
|---|---|---|---|---|
| 7,862,689 | B2 | 1/2011 | Kawasaki et al. | |
| 8,478,152 | B2 * | 7/2013 | Tomizawa | 399/66 |
| 8,494,384 | B2 * | 7/2013 | Furuya et al. | 399/44 |
| 2007/0279447 | A1 | 12/2007 | Kawasaki et al. | |
| 2009/0304429 | A1 * | 12/2009 | Makinodan | 399/406 |

FOREIGN PATENT DOCUMENTS

| | | |
|---|---|---|
| JP | A-2004-246164 | 9/2004 |
| JP | A-2007-240720 | 9/2007 |
| JP | A-2007-246164 | 9/2007 |
| JP | A-2007-322558 | 12/2007 |

OTHER PUBLICATIONS

Oct. 12, 2012 Patent Examination Report issued in Australian Patent Application No. 2011239289.

* cited by examiner

*Primary Examiner* — Clayton E LaBalle
*Assistant Examiner* — Leon W Rhodes, Jr.
(74) *Attorney, Agent, or Firm* — Oliff & Berridge, PLC

(57) ABSTRACT

An information processor includes a storage unit storing a first coefficient in correspondence with a characteristic of a sheet of paper, a first acquisition unit acquiring a first signal based on the water content of a first sheet of paper not having an image formed thereon, a second acquisition unit acquiring a second signal based on the water content of the first sheet of paper having an image formed thereon and being heated for fixing, a determination unit determining the characteristic of the first sheet of paper, a first calculation unit calculating a variation in water content of the first sheet of paper using the difference between the first signal and the second signal and the first coefficient stored in correspondence with the determined characteristic, and a second calculation unit calculating an expansion and contraction ratio of the first sheet of paper using the variation in water content.

17 Claims, 20 Drawing Sheets

FIG. 6

34

| TYPE \ BASIS WEIGHT | 50 ~ 100gsm | 100 ~ 150gsm | 150 ~ 200gsm | 200 ~ 250gsm | 250 ~ 300gsm | 300gsm ~ |
|---|---|---|---|---|---|---|
| MEDIUM-QUALITY PAPER | 0.29 | 0.32 | 0.35 | – | – | – |
| HIGH-QUALITY PAPER | 0.3 | 0.35 | 0.4 | 0.45 | 0.5 | 0.55 |
| COATED PAPER | 0.58 | 0.64 | 0.7 | 0.76 | 0.82 | 0.88 |

FIG. 8

35

| TYPE \ BASIS WEIGHT | | 50 ~ 100gsm | 100 ~ 150gsm | 150 ~ 200gsm | 200 ~ 250gsm | 250 ~ 300gsm | 300gsm ~ |
|---|---|---|---|---|---|---|---|
| MEDIUM-QUALITY PAPER | β1 | 0.055 | 0.057 | 0.059 | – | – | – |
| | β2 | 0.165 | 0.166 | 0.167 | – | – | – |
| HIGH-QUALITY PAPER | β1 | 0.055 | 0.056 | 0.057 | 0.059 | 0.061 | 0.062 |
| | β2 | 0.148 | 0.15 | 0.154 | 0.158 | 0.163 | 0.17 |
| COATED PAPER | β1 | 0.061 | 0.063 | 0.065 | 0.066 | 0.068 | 0.069 |
| | β2 | 0.168 | 0.162 | 0.150 | 0.135 | 0.120 | 0.110 |

INFORMATION PROCESSOR, IMAGE FORMING APPARATUS, INFORMATION PROCESSING METHOD, AND NON-TRANSITORY COMPUTER-READABLE MEDIUM

CROSS-REFERENCE TO RELATED APPLICATIONS

This application is based on and claims priority under 35 USC 119 from Japanese Patent Application No. 2011-058118 filed Mar. 16, 2011.

BACKGROUND (i) Technical Field

The present invention relates to an information processor, an image forming apparatus, an information processing method, and a non-transitory computer-readable medium.

(ii) Related Art

A sheet of paper used in an image forming apparatus varies in condition with a variation in water content. When the condition of the sheet of paper varies, it has various influences on the formation of an image. A technique of suppressing the influence and forming an appropriate image is known.

SUMMARY

According to an aspect of the invention, there is provided an information processor including: a storage unit that stores a first coefficient, which is preset on the basis of the relationship between a water content of a sheet of paper and a signal output from a signal output unit on the basis of the water content when a sheet of paper having each characteristic has the water content, in correspondence with the characteristics; a first acquisition unit that acquires a first signal output from the signal output unit on the basis of the water content of a first sheet of paper not having a first image formed thereon; a second acquisition unit that acquires a second signal output from the signal output unit on the basis of the water content of the first sheet of paper which has the first image formed on a first surface thereof and which is heated to fix the first image; a determination unit that determines the characteristic of the first sheet of paper; a first calculation unit that calculates a variation in water content of the first sheet of paper using the difference between the acquired first signal and the acquired second signal and the first coefficient stored in correspondence with the determined characteristic in the storage unit; and a second calculation unit that calculates an expansion and contraction ratio of the first sheet of paper using the variation in water content calculated by the first calculation unit.

BRIEF DESCRIPTION OF THE DRAWINGS

Exemplary embodiments of the present invention will be described in detail based on the following figures, wherein:

FIG. 6 is a diagram illustrating an example of a first correction table;

FIG. 8 is a diagram illustrating an example of a second correction table;

DETAILED DESCRIPTION

1. First Exemplary Embodiment

Figure 1:
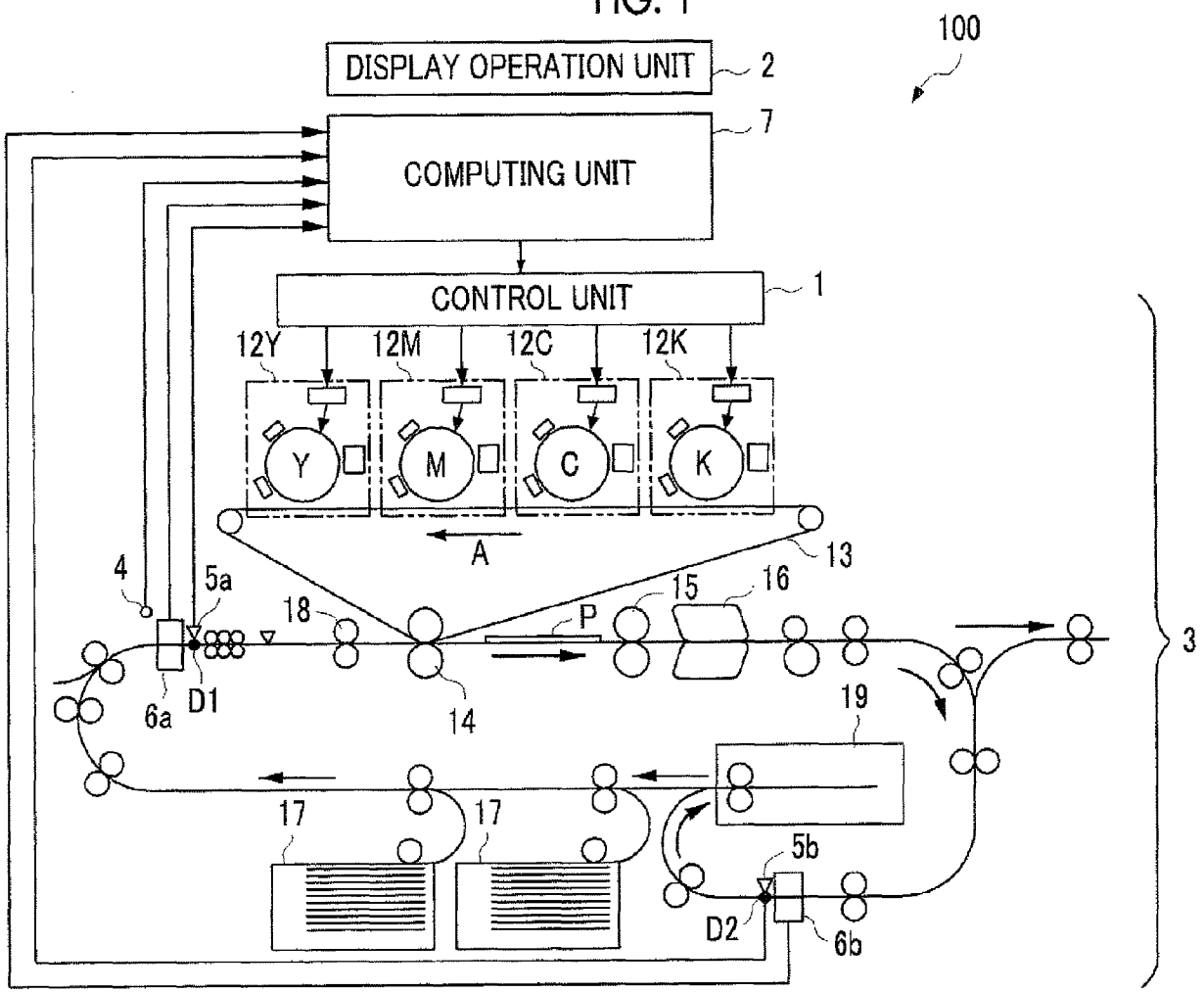
FIG. 1 is a diagram illustrating the configuration of an image forming apparatus according to a first exemplary embodiment of the invention.

FIG. 1 is a diagram illustrating the configuration of an image forming apparatus 100 according to a first exemplary embodiment of the invention. The image forming apparatus 100 includes a control unit 1, a display operation unit 2, an image forming unit 3, a temperature sensor 4, sheet sensors 5*a* and 5*b*, water content sensors 6*a* and 6*b*, and a computing unit 7. The control unit 1 includes a central processing unit (CPU) and a memory. The CPU controls the units of the image forming apparatus 100 by executing programs stored in the memory. The display operation unit 2 includes, for example, a touch panel, displays an image, and receives a user's operation. The image forming unit 3 forms an image on a sheet of paper P under the control of the control unit 1. The image forming unit 3 has a function of forming an image on both surfaces of the sheet of paper P. In the description below, the surface of a sheet of paper P having an image first formed thereon is referred to as a first surface and the surface having an image later formed thereon is referred to as a second surface.

The image forming unit 3 includes image forming sections 12Y, 12M, 12C, and 12K, an intermediate transfer belt 13, a secondary transfer roller 14, a fixing unit 15, a cooling unit 16, a sheet feeding unit 17, a register roller 18, and a turnover unit 19. The image forming sections 12Y, 12M, 12C, and 12K form toner images of yellow, magenta, cyan, and black, respectively, and transfer the formed toner images to the intermediate transfer belt 13. More specifically, each of the image forming sections 12Y, 12M, 12C, and 12K includes a photosensitive drum, a charging device, an exposing device, a developing device, and a primary transfer roller. The photosensitive drum has a photosensitive layer and rotates about an axis. The charging device uniformly charges the surface of the photosensitive drum. The exposing device exposes the charged photosensitive drum to light to form an electrostatic latent image. The developing device develops the electrostatic latent image formed on the photosensitive drum with toner to form a toner image. The primary transfer roller transfers the toner image formed on the photosensitive drum to the intermediate transfer belt 13.

The intermediate transfer belt 13 rotates in the direction of arrow A in the drawing and carries the toner images transferred by the image forming sections 12Y, 12M, 12C, and 12K to the secondary transfer roller 14. The secondary transfer roller 14 transfers the toner images carried by the intermediate transfer belt 13 to a sheet of paper P. Accordingly, an image is formed on the sheet of paper P. The fixing unit 15 fixes the toner image to the sheet of paper P by applying heat and pressure. The cooling unit 16 cools the sheet of paper P passing through the fixing unit 15. The sheet feeding unit 17 receives plural sheets of paper P and feeds the sheets of paper P sheet by sheet. The register roller 18 positions the sheet of paper P sent from the sheet feeding unit 17 or the turnover unit 19 and sends out the sheet of paper P to the secondary transfer roller 14. The turnover unit 19 turns over the sheet of paper P after an image is formed on the first surface of the sheet P when images are formed on both surfaces of the sheet of paper P.

Figure 2:
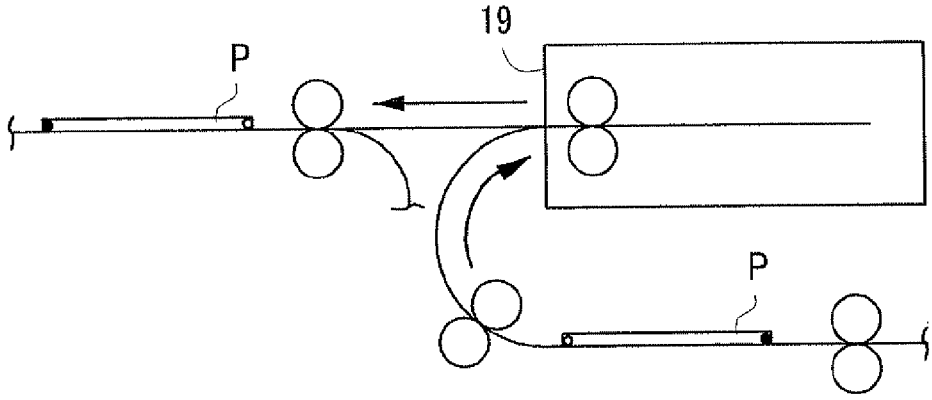
FIG. 2 is a diagram illustrating an action of turning over a sheet of paper.

FIG. 2 is a diagram illustrating an action of turning over a sheet of paper P. When a sheet of paper P is carried, the turnover unit 19 turns over the sheet of paper P by the switch back carrying action. At this time, since the traveling direction of the sheet of paper P is reversed, the leading edge and the trailing edge of the sheet of paper P are inverted. In FIG. 2, an edge marked by a white circle is the leading edge before entering the turnover unit 19, but the edge marked by a black circle is the leading edge after going out of the turnover unit 19. The sheet of paper P turned over by the turnover unit 19 is carried again to the secondary transfer roller 14 and an image is formed on the second surface thereof. Thereafter, the sheet of paper P is discharged to the outside of the image forming apparatus 100 via the fixing unit 15 and the cooling unit 16.

Referring to FIG. 1 again, the temperature sensor 4 (an example of the measuring unit) measures the temperature around the water content sensor 6*a* and outputs a signal representing the measured temperature. The sheet sensor 5*a* senses the sheet of paper P, when the leading edge of the sheet of paper P reaches a sensing position D1. The sheet sensor 5*b* senses the sheet of paper P, when the leading edge of the sheet of paper P reaches a sensing position D2. The sheet sensors 5*a* and 5*b* sense the sheet of paper P, for example, using light. The water content sensor 6*a* measures the water content of the sheet of paper P when the leading edge of the sheet of paper P not having an image formed thereon reaches the sensing position D1 and the sheet of paper P is sensed by the sheet sensor 5*a*. Specifically, the water content sensor 6*a* outputs a signal (an example of the first signal) corresponding to the water content of the sheet of paper P, by applying light of a predetermined wavelength to the sheet of paper P. The water content sensor 6*b* measures the water content of the sheet of paper P when the leading edge of the sheet of paper P, which has an image formed on the first surface thereof and which is heated to fix the image, reaches the sensing position D2 and the sheet of paper P is sensed by the sheet sensor 5*b*. Specifically, the water content sensor 6*b* outputs a signal (an example of the second signal) corresponding to the water content of the sheet of paper P, by applying light of a predetermined wavelength to the sheet of paper P. In the first exemplary embodiment, the water content sensors 6*a* and 6*b* serve together as the signal output unit. In the below description, when it is not necessary to distinguish the water content sensors 6*a* and 6*b* from each other, they are collectively referred to as "water content sensor 6".

Figure 3:
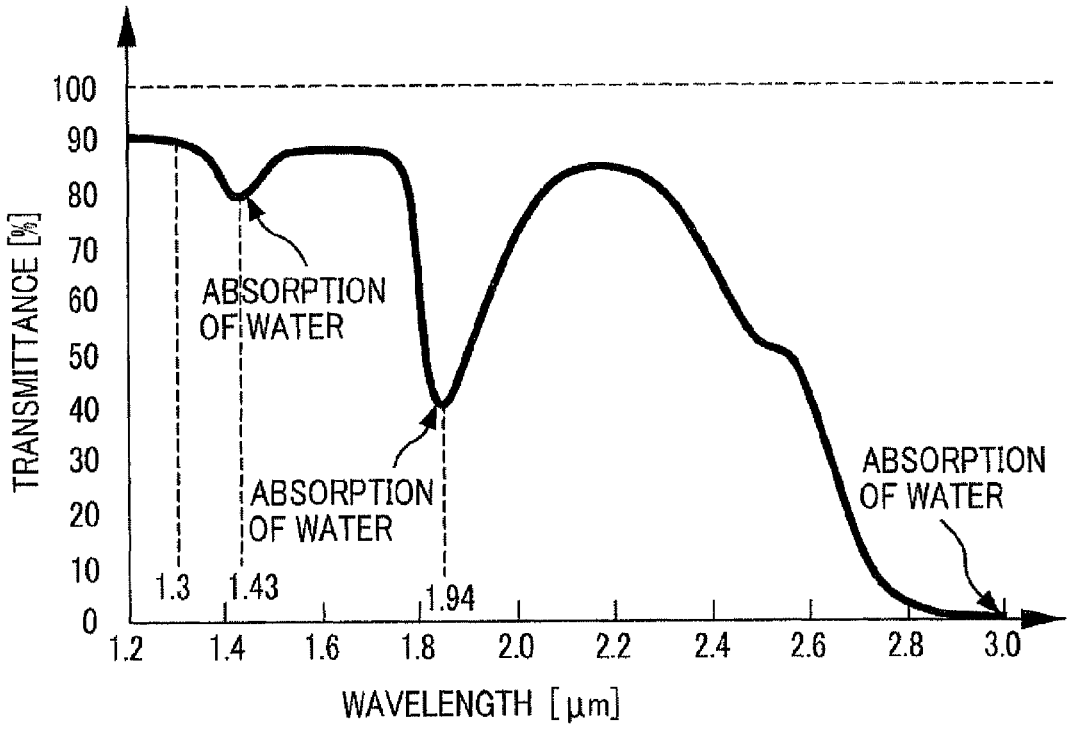
FIG. 3 is a diagram illustrating the light-transmitting characteristic of water.

The principle of the water content sensor 6 will be described below with reference to FIG. 3. FIG. 3 is a diagram illustrating the light-transmitting characteristic of water. Water has high optical transmittance in a wavelength band equal to or less than 1.3 μm and has low optical transmittance in wavelength bands of 1.43 μm, 1.94 μm, and 3.0 μm. That is, in the wavelength bands of 1.43 μm, 1.94 μm, and 3.0 μm, the optical absorptance of water is high. In this case, when light of a wavelength of 1.3 μm and light of several wavelengths of 1.43 μm, 1.94 μm, and 3.0 μm are applied to the sheet of paper P, the difference in optical reflectance varies depending on the water content of the sheet of paper P. Specifically, the difference in reflectance is high when the water content of the sheet of paper P is large, and the difference in reflectance is small when the water content of the sheet of paper P is small. Accordingly, when the light of a wavelength of 1.3 μm and the light of several wavelengths of 1.43 μm, 1.94 μm, and 3.0 μm are applied to the sheet of paper P and the difference in reflectance of the light is measured, the water content of the sheet of paper P is acquired from the measured difference in reflectance.

Figure 4:
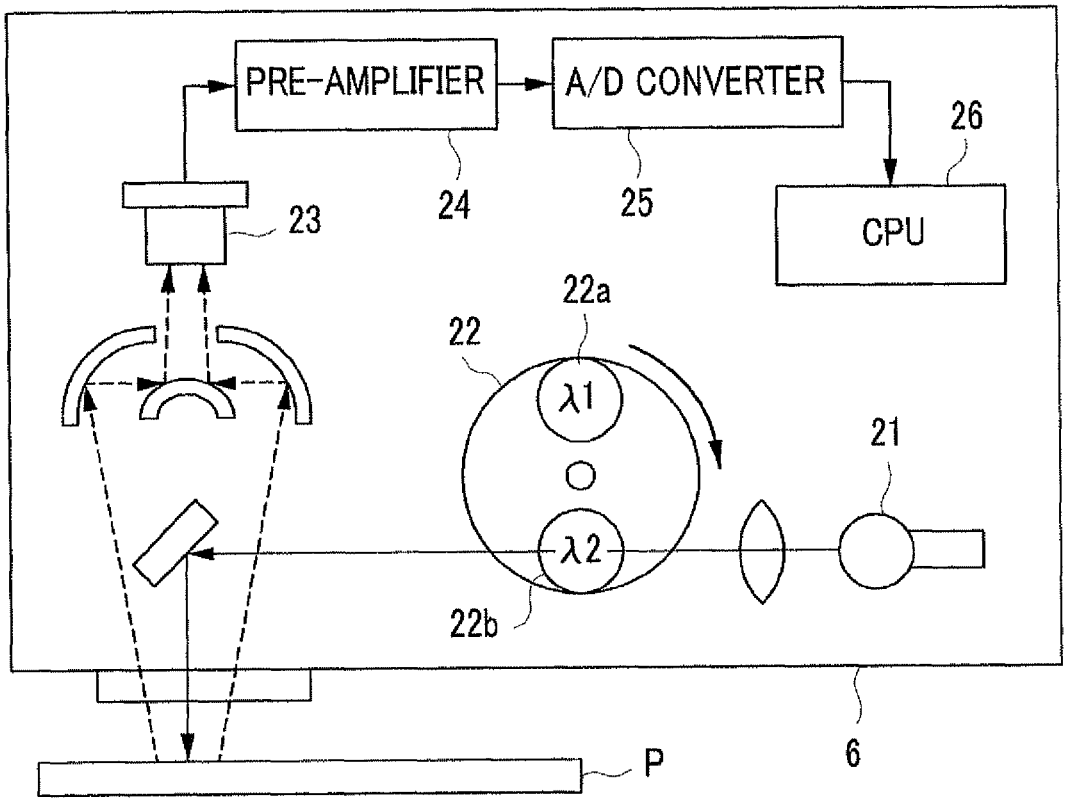
FIG. 4 is a diagram illustrating the configuration of a water content sensor.

FIG. 4 is a diagram illustrating the configuration of a water content sensor 6. The water content sensor 6 includes a light-emitting portion 21, a filter portion 22, a light-receiving portion 23, a pre-amplifier 24, an A/D converter 25, and a CPU 26. The light-emitting portion 21 emits light. The filter portion 22 includes a wavelength filter 22*a* and a wavelength filter 22*b*. The wavelength filter 22*a* transmits only the light of wavelength λ1 out of the light emitted from the light-emitting portion 21. The wavelength filter 22*b* transmits only the light of a wavelength λ2 out of the light emitted from the light-emitting portion 21. Here, 1.3 μm is employed as the wavelength λ1 and 1.43 μm is employed as the wavelength λ2. 1.94 μm or 3.0 μm may be employed as the wavelength λ1. The wavelength filters 22*a* and 22*b* sequentially move to the path of the light emitted from the light-emitting portion 21 with the rotation of the filter portion 22. The light passing through the wavelength filter 22*a* or 22*b* is guided to the sheet of paper P by a mirror.

The light-receiving portion 23 receives the light reflected by the sheet of paper P, converts the received light into an electrical signal, and outputs the electrical signals. The pre-amplifier 24 amplifies and outputs the electrical signal output from the light-receiving portion 23. The A/D converter 25 converts the analog electrical signal output from the pre-amplifier 24 into a digital electrical signal and outputs the digital electrical signal. The CPU 26 calculates a difference between the reflectance of the light of a wavelength λ1 and the reflectance of the light of a wavelength λ2 on the basis of the electrical signal output from the A/D converter 25. Then, the CPU 26 outputs a signal corresponding to the calculated difference in reflectance.

Figure 5:
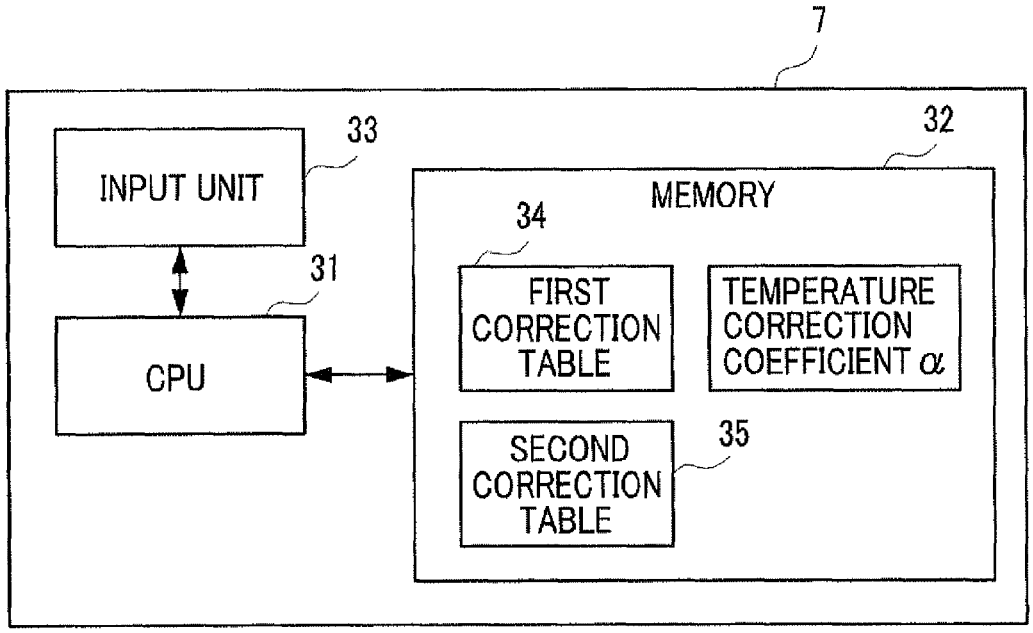
FIG. 5 is a diagram illustrating the configuration of a computing unit.

FIG. 5 is a diagram illustrating the configuration of the computing unit 7. The computing unit 7 (an example of the information processor) includes a CPU 31, a memory 32, and an input unit 33. The CPU 31 performs a variety of processes by executing a program stored in the memory 32. The memory 32 (an example of the storage unit) stores a first correction table 34, a second correction table 35, and a temperature correction coefficient α, in addition to the program to be executed by the CPU 31. The input unit 33 receives sheet information input through the use of, for example, the display operation unit 2. The sheet information includes information representing the type of a sheet of paper and information representing the basis weight of a sheet of paper. The type of a sheet of paper means the classifications of sheets of paper such as coated paper and high-quality paper. The basis weight of a sheet of paper means the weight per 1 square meters of a sheet of paper.

Figure 7:
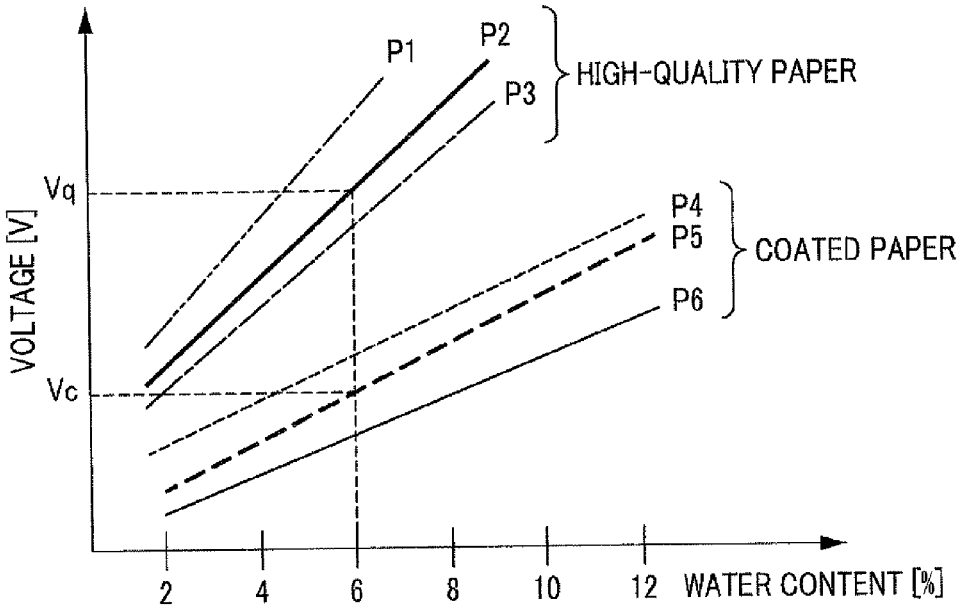
FIG. 7 is a diagram illustrating an example of the relationship between a water content of a sheet of paper and a voltage of a signal output from a water content sensor.

FIG. 6 is a diagram illustrating an example of the first correction table 34. In the first correction table 34, a coefficient γ (an example of the first coefficient) is described in correspondence with the "type" and the "basis weight" of the sheets of paper. The coefficient γ is a coefficient preset on the basis of the relationship between a water content of a sheet of paper and a signal output from the water content sensor 6 on the basis of the water content when the sheet of paper having the "type" and the "basis weight" has this water content. FIG. 7 is a diagram illustrating the relationship between a water content of a sheet of paper and a voltage of the signal output from the water content sensor 6. Sheets of paper P1 to P3 are all high-quality paper but are different in basis weight or specific type. Sheets of paper P4 to P6 are all coated paper but are different in basis weight or specific type. That is, the sheets of paper P1 to P6 have different characteristics. For example, when the water content of the sheet of paper P2 is 6%, the voltage of the signal output from the water content sensor 6 on the basis of this water content is Vq. On the other hand, when the water content of the sheet of paper P5 is 6%, the voltage of the signal output from the water content sensor 6 on the basis of this water content is Vc. In this way, when the water contents are equal to each other but the characteristics of the sheets of paper P are different, the voltage of the signal output from the water content sensor 6 has an error. The coefficient γ is used to correct this error.

The temperature correction coefficient α is a coefficient which is preset on the basis of the relationship between the temperature and the signal output from the water content sensor 6. The voltage of the signal output from the water content sensor 6 may have an error depending on the temperature around the water content sensor 6. The temperature correction coefficient α is used to correct the error.

Figure 9:
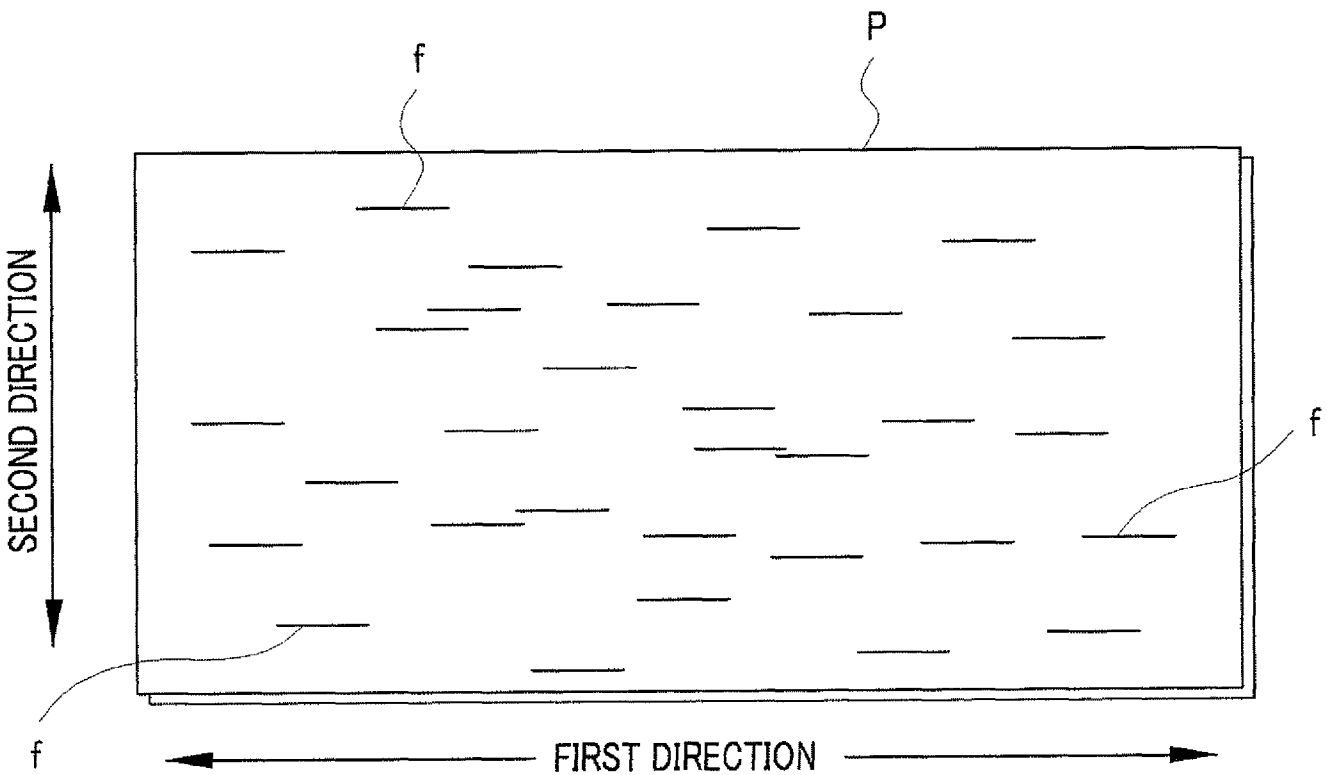
FIG. 9 is a diagram illustrating an example of a sheet of paper.
Figure 10:
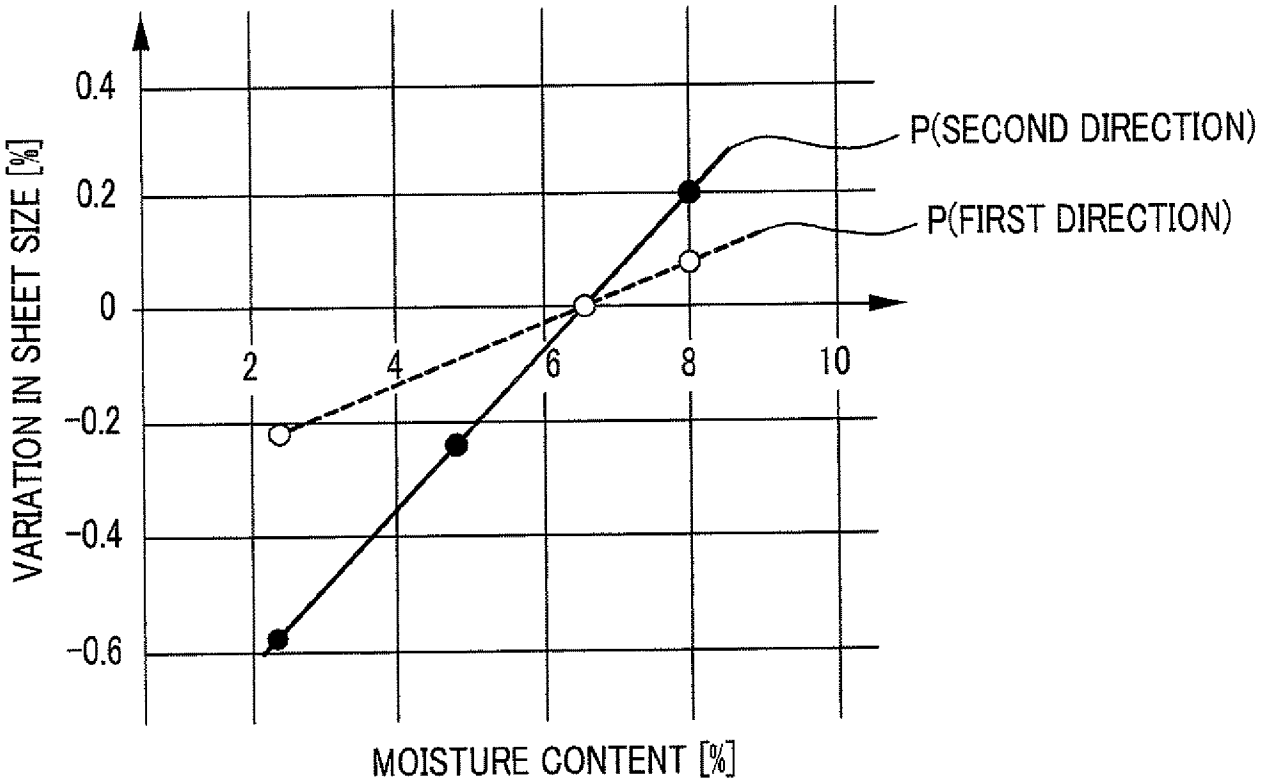
FIG. 10 is a diagram illustrating an example of the relationship between a water content of a sheet of paper and a size variation.

FIG. 8 is a diagram illustrating an example of the second correction table 35. In the second correction table 35, coefficients β1 and β2 (an example of the second coefficient) are described in correspondence with the "type" and the "basis weight" of the sheets of paper. The coefficients β1 and β2 are coefficients which are preset on the basis of the relationship between a variation in water content of a sheet of paper and an expansion and contraction ratio of the sheet of paper when the water content of the sheet of paper having the "type" and the "basis weight" varies by the variation. The coefficient β1 is a coefficient regarding the expansion and contraction ratio in a first direction of a sheet of paper. The coefficient β2 is a coefficient regarding the expansion and contraction ratio in a second direction of the sheet of paper. The first direction is an arranging direction of fibers included in the sheet of paper. The second direction is a direction intersecting the first direction. FIG. 9 is a diagram illustrating an example of the sheet of paper P. In FIG. 9, the fibers f included in the sheet of paper P are arranged along the longitudinal direction of the sheet of paper P. In this case, the longitudinal direction of the sheet of paper P is the first direction and the transverse direction of the sheet of paper P is the second direction. FIG. 10 is a diagram illustrating an example of the relationship between the water content of a sheet of paper and a size variation thereof. For example, when the water content of a sheet of paper P decreases from 6% to 4%, the size variation in the second direction of the sheet of paper P is larger in the minus direction than the size variation in the first direction. This means that the size of the sheet of paper P is reduced more greatly in the second direction than in the first direction. In this way, the expansion and contraction ratio in the first direction and the expansion and contraction ratio in the second direction are different for a sheet of paper P. Accordingly, the coefficient β1 and the coefficient β2 are described in the second correction table 35.

Figure 11:
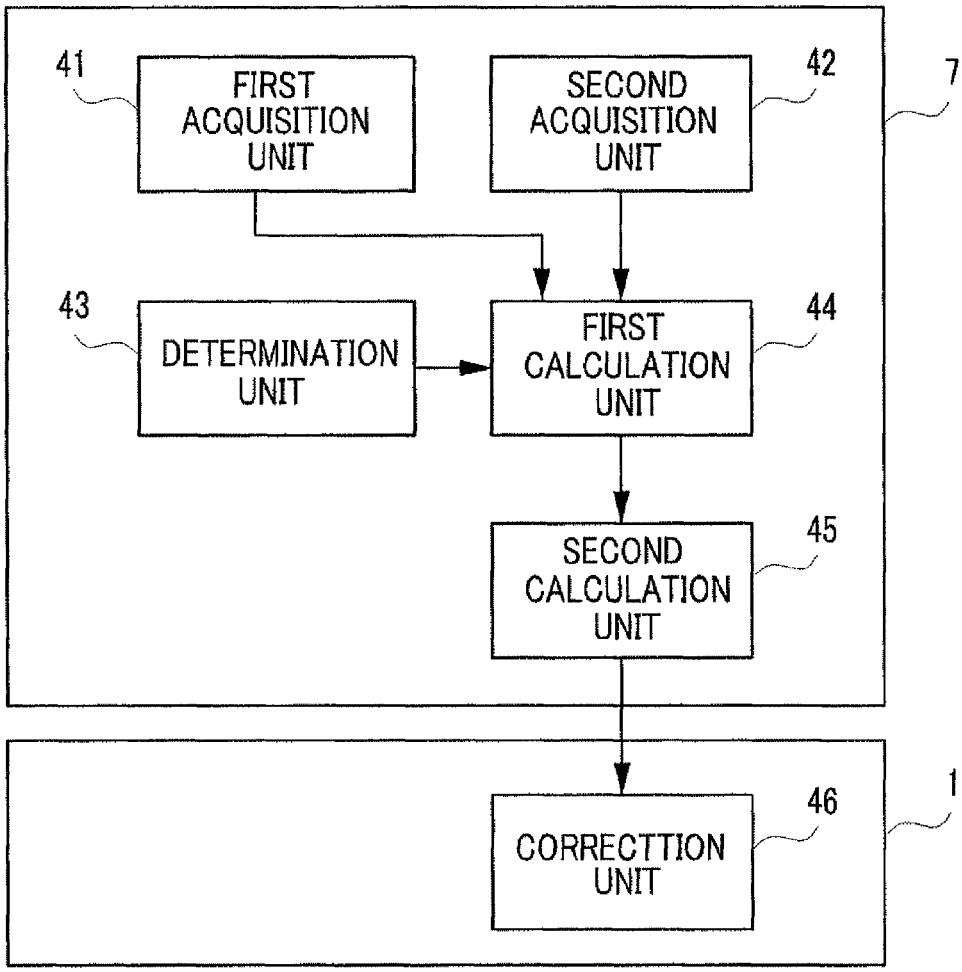
FIG. 11 is a diagram illustrating the functional configuration of a computing unit and a control unit.

FIG. 11 is a diagram illustrating the functional configuration of the computing unit 7 and the control unit 1. The computing unit 7 serves as a first acquisition unit 41, a second acquisition unit 42, a determination unit 43, a first calculation unit 44, and a second calculation unit 45. The first acquisition unit 41 acquires a first signal output from the water content sensor 6*a* on the basis of the water content of a sheet of paper P not having a first image formed thereon. The second acquisition unit 42 acquires a second signal output from the water content sensor 6*b* on the basis of the water content of the sheet of paper P having a first image formed on the first surface thereof and being heated to fix the first image. The determination unit 43 determines the characteristics of the sheet of paper P. The first calculation unit 44 calculates a variation in water content of the sheet of paper P using the difference between the first signal acquired by the first acquisition unit 41 and the second signal acquired by the second acquisition unit 42 and the coefficient γ stored in correspondence with the characteristic, which is determined by the determination unit 43, in the memory 32. The second calculation unit 45 calculates the expansion and contraction ratio of the sheet of paper P using the variation in water content calculated by the first calculation unit 44. The control unit 1 serves as the correction unit 46. The correction unit 46 corrects the size or position of the second image to be formed on the second surface of the sheet of paper P on the basis of the expansion and contraction ratio calculated by the second calculation unit 45.

When the water content of a sheet of paper P varies, the sheet of paper P expands or contracts. For example, when the sheet of paper P passes through the fixing unit 15, it is heated by the fixing unit 15 and the amount of water contained in the sheet of paper P decreases. At this time, the sheet of paper P contracts by the decreasing amount of water. When images are formed on both surfaces of the sheet of paper P, an image is formed on the second surface after the sheet of paper P contracts. In this case, when the images are formed on the first and second surfaces of the sheet of paper P under the same conditions, the images vary in size or position.

Figure 12A:
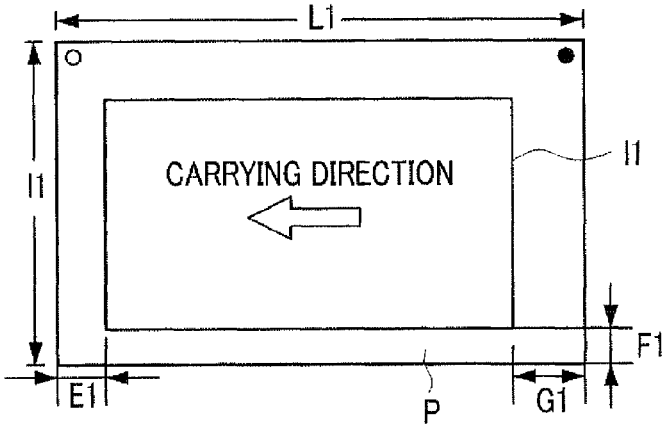
FIGS. 12A, 12B, and 12C are diagrams illustrating the reason for image misalignment.
Figure 12B:
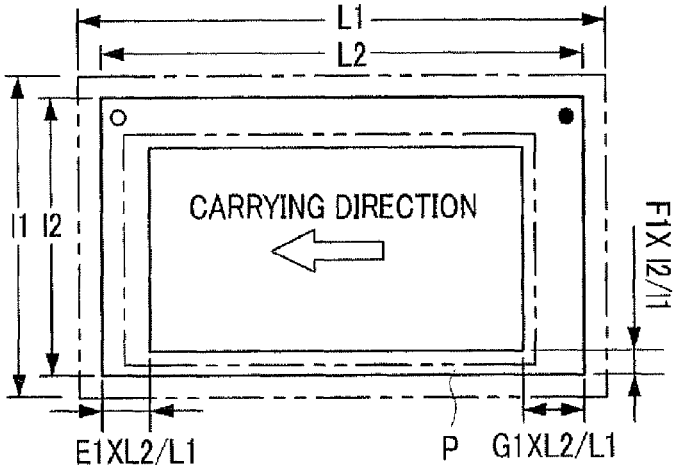
Figure 12C:
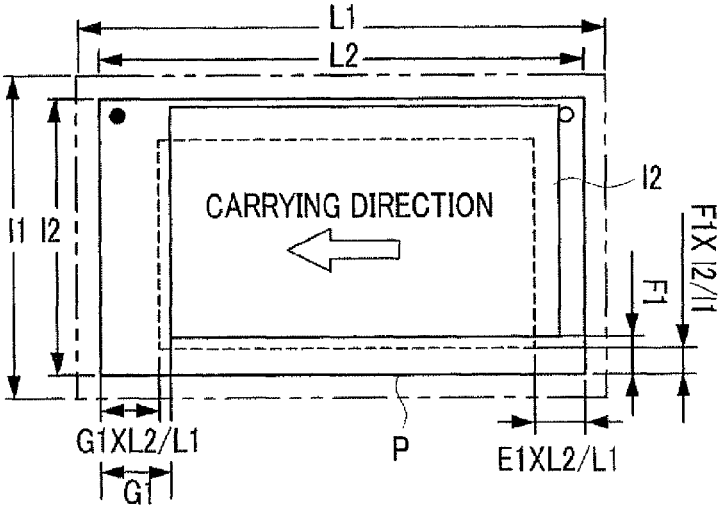

FIGS. 12A, 12B, and 12C are diagrams illustrating the reason for the variation. In FIGS. 12A, 12B, and 12C, an edge in the carrying direction of a sheet of paper P is referred to as a top edge, and the edge opposite to the top edge is referred to as a bottom edge. An edge on the right side in the carrying direction of a sheet of paper P is referred to as a right edge and the edge on the left side is referred to as a left edge. When images are formed on both surfaces of a sheet of paper P, an image I1 is first transferred to the first surface of the sheet of paper P, as shown in FIG. 12A. At this time, the length in the longitudinal direction of the sheet of paper P is L1 and the length in the transverse direction is l1. The formation of the image I1 is started from a position separated apart by a distance E1 from the top edge of the sheet of paper P and apart by a distance F1 from the left edge of the sheet of paper P. At this time, the distance between the bottom edge of the sheet of paper P and the image I1 is G1.

After the image I1 is formed on the first surface, the sheet of paper P is heated by the fixing unit 15. Accordingly, as shown in FIG. 12B, the sheet of paper P contracts. At this time, the length in the longitudinal direction of the sheet of paper P is L2 and the length in the transverse direction is l2. When the sheet of paper P contracts in this way, the length in the longitudinal direction of the image I1 is L2/L1 of the original length and the length in the transverse direction is l2/l1 of the original length. The distance between the top edge of the sheet of paper P and the image I1 is (E1×L2/L1). The distance between the left edge of the sheet of paper P and the image I1 is (F1×l2/l1). The distance between the bottom edge of the sheet of paper P and the image I1 is (G2×L2/L1).

An image I2 is formed on the second surface of the sheet of paper P as shown in FIG. 12C. In FIGS. 12A, 12B, and 12C, an edge marked by a white circle and an edge marked by a black circle are the same edges. That is, in FIGS. 12A and 12B, the edge marked by the white circle is the top edge and the edge marked by the black circle is the bottom edge. In FIG. 12C, the edge marked by the black circle is the top edge and the edge marked by the white circle is the bottom edge. This is because the sheet of paper P shown in FIG. 12C is turned over by the switchback carrying in the turnover unit 19.

The image I2 is formed on the second surface of the sheet of paper P with the same magnification as the image I1. As described above, the image I1 formed on the first surface of the sheet of paper P is reduced with the contraction of the sheet of paper P. Accordingly, the image I1 formed on the first surface of the sheet of paper P and the image I2 formed on the second surface are different in size. The formation of the image I2 is started from the position separated apart by the distance G1 from the top edge of the sheet of paper P and apart from the distance F1 from the left edge of the sheet of paper P. In this case, the position at which an image is formed is different between the first surface and the second surface of the sheet of paper P.

Figure 13:
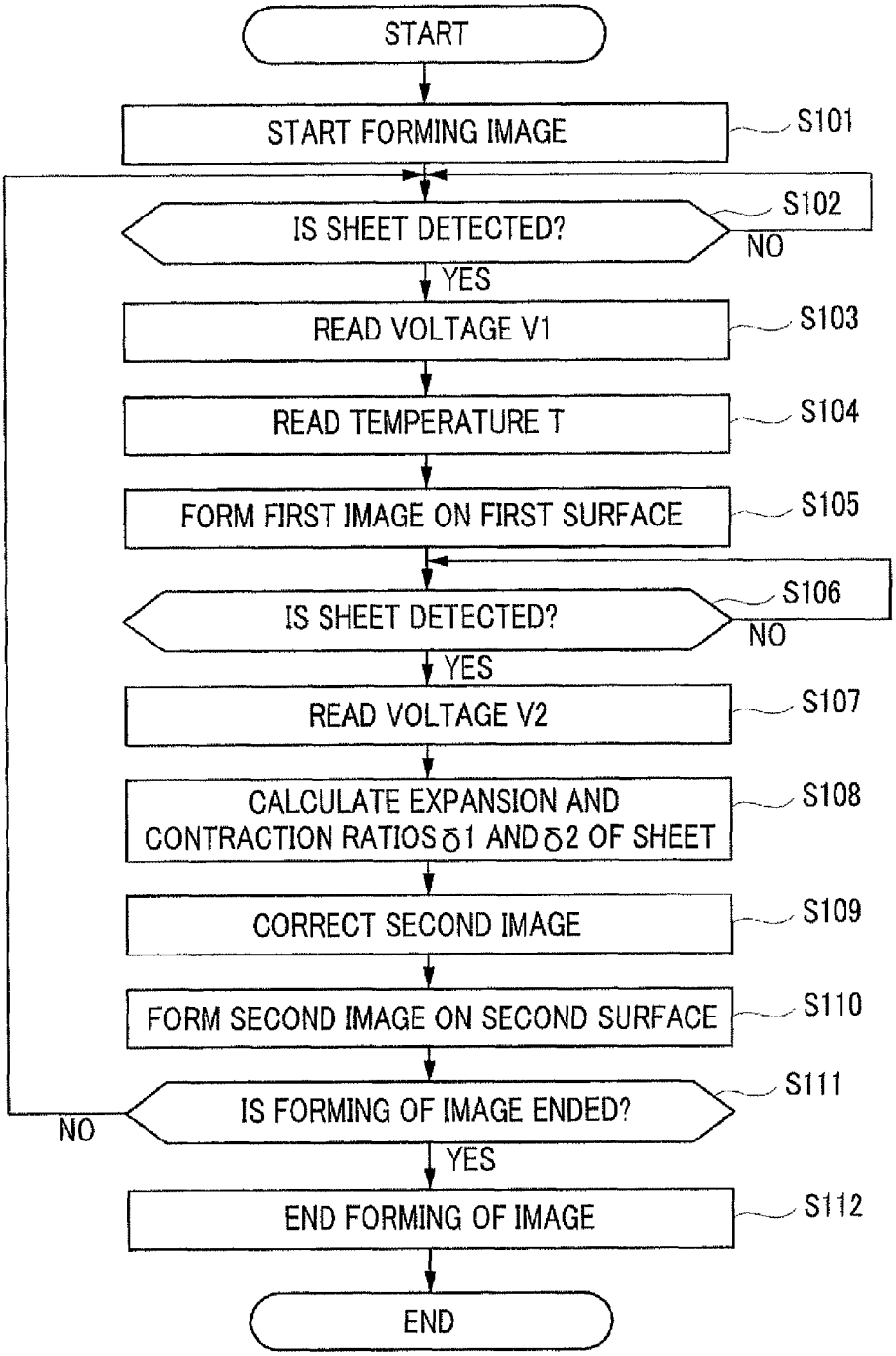
FIG. 13 is a flowchart illustrating a process performed by the image forming apparatus according to the first exemplary embodiment.

The image forming apparatus 100 performs the following process to correct such a difference. FIG. 13 is a flowchart illustrating the process performed by the image forming apparatus 100. In step S101, when an instruction to form images on both surfaces of a sheet of paper P is input, the control unit 1 starts the formation of an image. This instruction includes first image data representing the first image to be formed on the first surface of the sheet of paper P and second image data representing the second image to be formed on the second surface of the sheet of paper P.

In step S102, the water content sensor 6*a* determines whether the sheet sensor 5*a* senses a sheet of paper P. This determination is repeatedly performed until the sheet sensor 5*a* senses a sheet of paper P (NO in step S102). When a sheet of paper P is carried to the sensing position D1 from the sheet feeding unit 17, the sheet sensor 5*a* senses the sheet of paper P. When the sheet sensor 5*a* senses the sheet of paper P (YES in step S102), the water content sensor 6*a* applies light to the sheet of paper P and outputs a signal corresponding to the water content of the sheet of paper P. In step S103, the computing unit 7 acquires the signal output from the water content sensor 6*a* and reads the voltage V1 of the signal. Then, the computing unit 7 stores data representing the read voltage V1 in the memory 32. In step S104, the computing unit 7 reads the temperature T measured by the temperature sensor 4 on the basis of the signal output from the temperature sensor 4. Then, the computing unit 7 stores data representing the read temperature T in the memory 32.

In step S105, the image forming unit 3 forms a first image on the first surface of the sheet of paper P on the basis of the first image data. Then, the image forming unit 3 heats the sheet of paper P by the use of the fixing unit 15 to fix the first image. The sheet of paper P passing through the fixing unit 15 is cooled by the cooling unit 16. The sheet of paper P passing through the cooling unit 16 is carried to the sensing position D2.

In step S106, the water content sensor 6*b* determines whether the sheet sensor 5*b* senses the sheet of paper P. This determination is repeatedly performed until the sheet sensor 5*b* senses the sheet of paper P (NO in step S106). When the sheet of paper P is carried to the sensing position D2, the sheet sensor 5*b* senses the sheet of paper P. When the sheet sensor 5*b* senses the sheet of paper P (YES in step S106), the water content sensor 6*b* applies light to the sheet of paper P and outputs a signal corresponding to the water content of the sheet of paper P. In step S107, the computing unit 7 acquires the signal output from the water content sensor 6*b* and reads the voltage V2 of the signal. Then, the computing unit 7 stores data representing the read voltage V2 in the memory 32. As described above, the water content of the sheet of paper P is reduced by passing through the fixing unit 15. Accordingly, the voltage V2 is smaller than the voltage V1.

In step S108, the computing unit 7 calculates the expansion and contraction ratios δ1 and δ2 of the sheet of paper P. The expansion and contraction ratio is a ratio of the size after expansion and contraction to the original size in terms of percentage. For example, when the original size is 10 and the size after the expansion and contraction is 9, the expansion and contraction ratio is (9−10)÷10×100=−10%.

Figure 14:
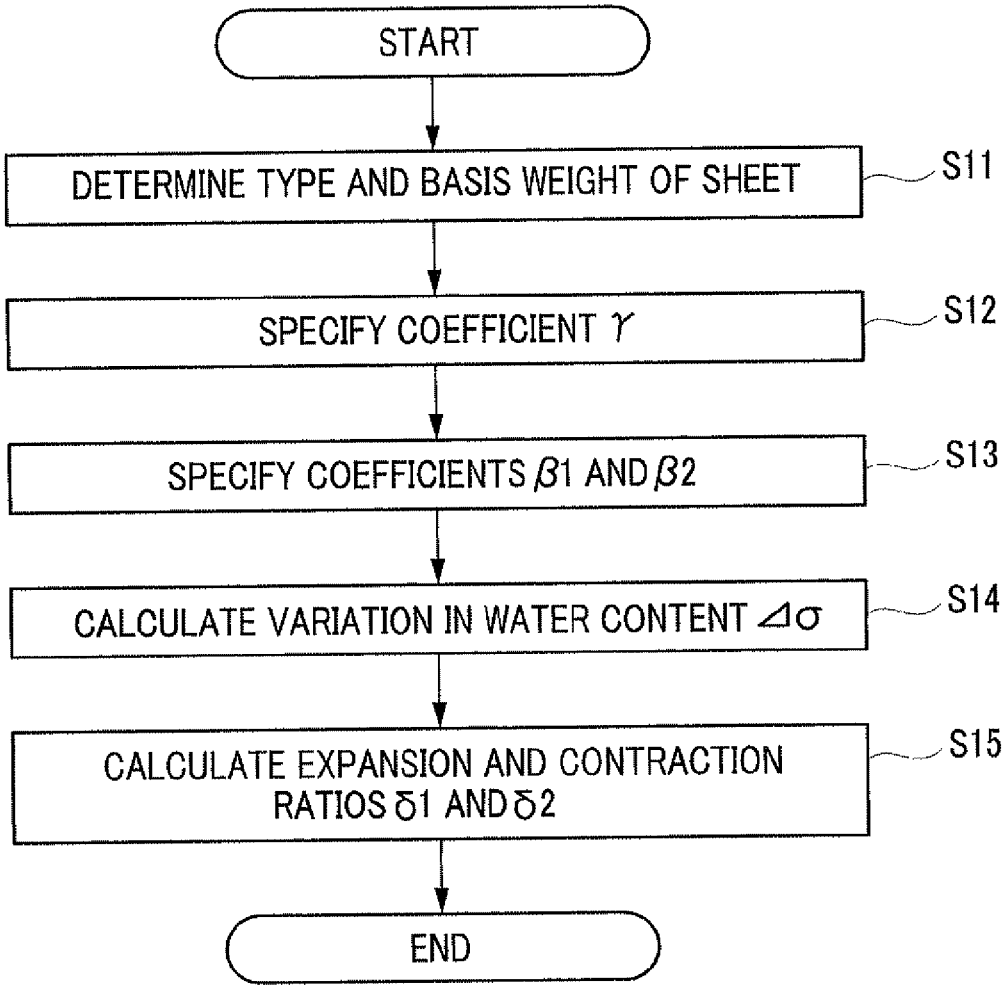
FIG. 14 is a flowchart illustrating a process of calculating an expansion and contraction ratio of a sheet of paper.

FIG. 14 is a flowchart illustrating the process of calculating the expansion and contraction ratios δ1 and δ2 of the sheet of paper P. In step S11, the computing unit 7 determines the type and the basis weight of the sheet of paper P on the basis of the sheet information input to the input unit 33. In step S12, the computing unit 7 specifies the coefficient γ, which is correlated with the type and the basis weight of the sheet of paper P determined in step S11, described in the first correction table 34 stored in the memory 32. For example, when the type of the sheet of paper P determined in step S11 is "high-quality paper" and the basis weight is "150 to 200 g/m$^2$", the correction coefficient γ=0.4 described in the first correction table 34 shown in FIG. 6 is specified.

In step S13, the computing unit 7 specifies coefficients β1 and β2 described in correspondence with the type and the basis weight of the sheet of paper P determined in step s11 in the second correction table 35 stored in the memory 32. For example, when the type of the sheet of paper P determined in step S11 is "high-quality paper" and the basis weight is "150 to 200 g/m$^2$", the coefficients β1=0.057 and β2=0.154 described in the second correction table 35 shown in FIG. 8 are specified.

In step S14, the computing unit 7 calculates a variation in water content Δσ by the use of Expression 1 using the voltage V1, the voltage V2, and the temperature T represented by the data stored in the memory 32, the temperature correction coefficient α stored in the memory 32, and the coefficient γ specified in step S12.

$$\text{Variation in water content } \Delta\sigma=(V1-V2)\times\gamma\times T\times\alpha \qquad \text{Expression 1}$$

In step S15, the computing unit 7 calculates the expansion and contraction ratios δ1 and δ2 of the sheet of paper P by the use of Expressions 2 and 3 using the variation in water content Δσ calculated in step S15 and the coefficients β1 and β2 specified in step S13. The expansion and contraction ratio of the sheet of paper P represents an expansion and contraction ratio in the first direction of the sheet of paper P. The expansion and contraction ratio δ2 of the sheet of paper P represents an expansion and contraction ratio in the second direction of the sheet of paper P.

$$\text{Expansion and contraction ratio } \delta 1 = \Delta\sigma \times \beta 1 \qquad \text{Expression 2}$$

$$\text{Expansion and contraction ratio } \delta 2 = \Delta\sigma \times \beta 2 \qquad \text{Expression 3}$$

Subsequently, the computing unit 7 stores the calculated expansion and contraction ratios δ1 and δ2 in the memory 32.

Referring to FIG. 13 again, in step S109, the control unit 1 corrects the second image represented by the second image data on the basis of the expansion and contraction ratios δ1 and δ2 stored in the memory 32. Specifically, the control unit 1 changes the size of the second image using the expansion and contraction ratios δ1 and δ2. For example, when the expansion and contraction ratio δ1 is −1% and the first direction corresponds to a sub scanning direction of the second image, the control unit 1 changes the length in the sub scanning direction of the second image to be smaller by 1% than the original length. That is, the control unit 1 changes the length in the sub scanning direction of the second image to 99% of the original length. When the expansion and contraction ratio δ2 is −2% and the second direction corresponds to a main scanning direction of the second image, the control unit 1 changes the length in the main scanning direction of the second image to be smaller by 2% than the original length. That is, the control unit 1 changes the length in the main scanning direction of the second image to 98% of the original length. Accordingly, the magnifications of an image on the first and second surfaces of the sheet of paper P are matched with each other.

The control unit 1 changes the distance between the edge of the sheet of paper P and the position at which the formation of an image is started using the expansion and contraction ratios δ1 and δ2. For example, when the expansion and contraction ratio δ1 is −1% and the first direction corresponds to the sub scanning direction of the second image, the control unit 1 changes the distance between the top edge of the sheet of paper P and the position at which the formation of an image is started to be smaller by 1% than the original distance. Similarly, when the expansion and contraction ratio δ2 is −2% and the second direction corresponds to the main scanning direction of the second image, the control unit 1 changes the distance between the left edge of the sheet of paper P and the position at which the formation of an image is started to be smaller by 2% than the original distance. Accordingly, the difference in the image forming position between the first surface and the second surface of the sheet of paper P is corrected.

The sheet of paper P passing through the water content sensor 6*b* is carried to the turnover unit 19. The sheet of paper P is turned over by the turnover unit 19. The sheet of paper P passing through the turnover unit 19 is carried to the secondary transfer roller 14 again. In step S110, the image forming unit 3 forms the second image on the second surface of the sheet of paper P on the basis of the second image data corrected in step S109. The image forming unit 3 heats the sheet of paper P by the use of the fixing unit 15 so as to fix the second image. The sheet of paper P passing through the fixing unit 15 is cooled by the cooling unit 16. The sheet of paper P passing through the cooling unit 16 is carried to the outside of the image forming apparatus 100.

In step S111, the control unit 1 determines whether the formation of all images is ended. When it is determined that an image to be formed remains (NO in step S111), the control unit 1 performs again the process of step S102. On the other hand, when it is determined that the formation of all images is ended (YES in step S111), the control unit 1 performs the process of step S112. In step S112, the control unit 1 ends the image forming process.

In the first exemplary embodiment, the coefficient γ described in the first correction table 34 is used to calculate the variation in water content Δσ. Accordingly, the error of the signal output from the water content sensor 6, which is based on the difference in characteristic of the sheet of paper P, is corrected. Accordingly, it is possible to improve the calculation precision of the expansion and contraction ratio of the sheet of paper P. In the first exemplary embodiment, the coefficients β1 and β2 described in the second correction table 35 are used to calculate the expansion and contraction ratios δ1 and δ2 of a sheet of paper. Accordingly, even when the expansion and contraction ratio in the first direction of the sheet of paper P and the expansion and contraction ratio in the second direction are different from each other, it is possible to calculate the expansion and contraction ratio of the sheet of paper P with high precision.

2. Second Exemplary Embodiment

Figure 15:
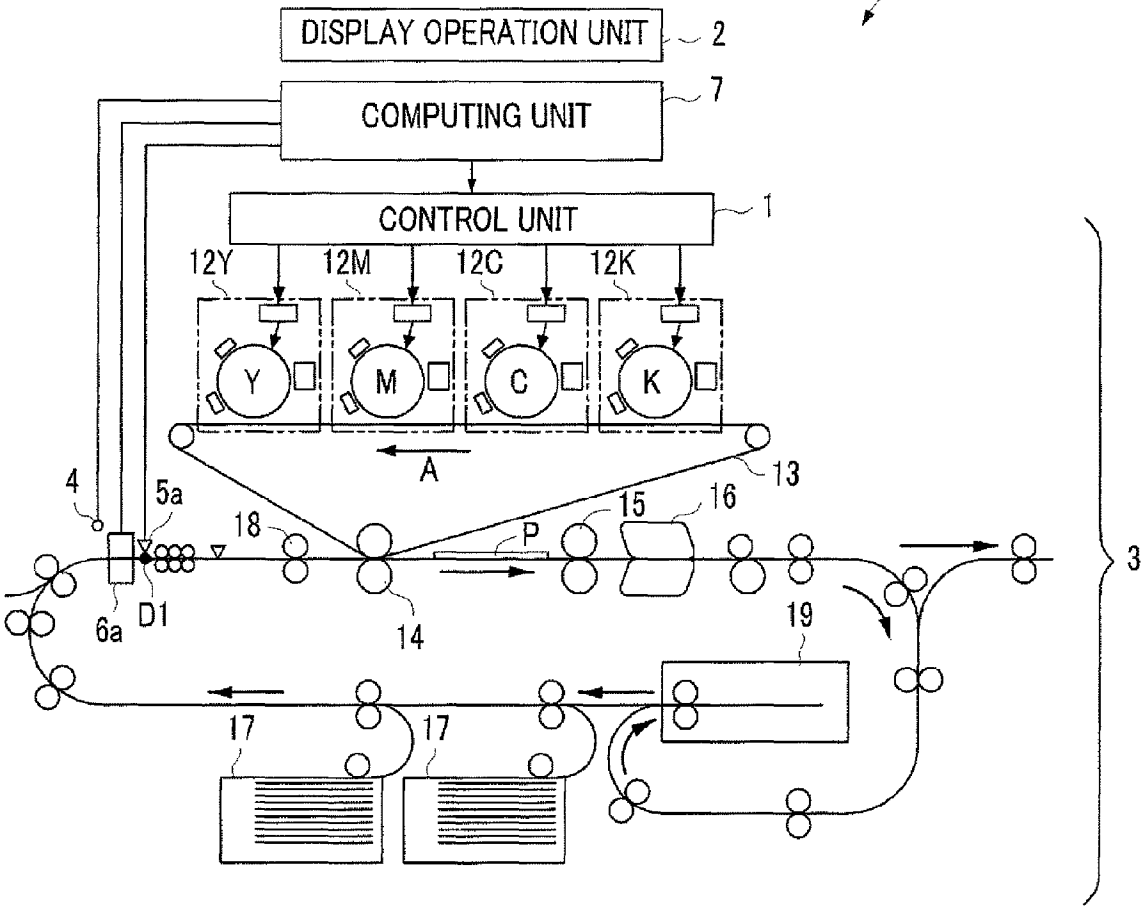
FIG. 15 is a diagram illustrating the configuration of an image forming apparatus according to a second exemplary embodiment of the invention.

FIG. 15 is a diagram illustrating the configuration of an image forming apparatus 200 according to a second exemplary embodiment of the invention. Similarly to the image forming apparatus 100, the image forming apparatus 200 includes a control unit 1, a display operation unit 2, an image forming unit 3, a temperature sensor 4, a sheet sensor 5*a*, a water content sensor 6*a*, and a computing unit 7. The sheet sensor 5*b* and the water content sensor 6*b* are not provided to the image forming apparatus 200.

The water content sensor 6*a* (an example of the signal output unit) in the second exemplary embodiment outputs a signal (an example of the first signal) corresponding to the water content of a sheet of paper P not having an image formed thereon and a signal (an example of the second signal) corresponding to the water content of the sheet of paper P having an image formed on the first surface thereof and being heated to fix the image. Specifically, when the leading edge of the sheet of paper P not having an image formed thereon reaches the sensing position D1 and the sheet of paper P is sensed by the sheet sensor 5*a*, the water content sensor 6*a* outputs a signal corresponding to the water content of the sheet of paper P. The sheet of paper P has a first image formed on the first surface thereof, is heated by the fixing unit 15, is turned over by the turnover unit 19, and is carried again to the sensing position D1. When the sheet of paper P reaches the sensing position D1 again and the sheet of paper P is sensed by the sheet sensor 5*a*, the water content sensor 6*a* outputs a signal corresponding to the water content of the sheet of paper P.

Figure 16:
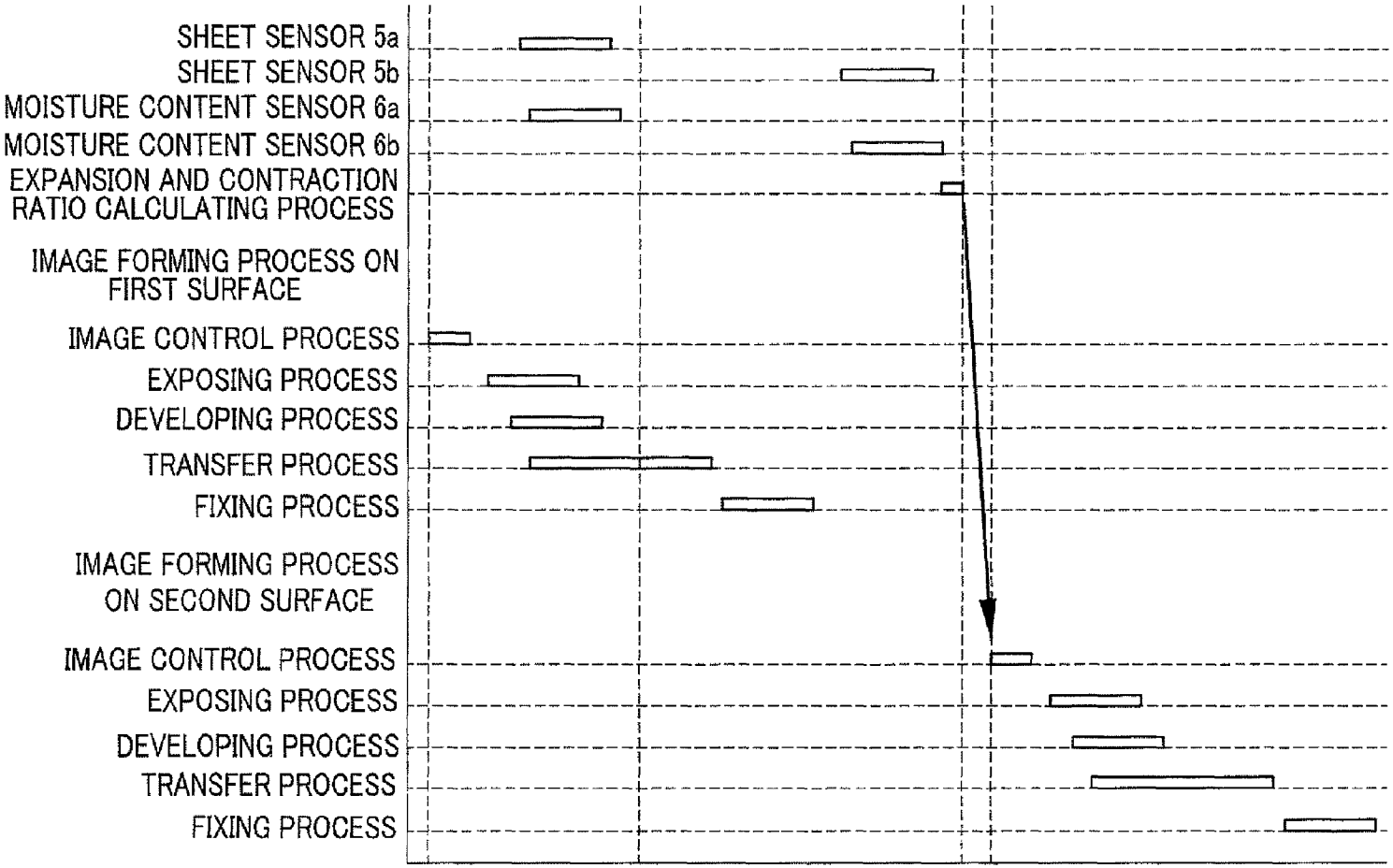
FIG. 16 is a timing diagram illustrating the behavior of the image forming apparatus according to the first exemplary embodiment.

The operating timing of the image forming apparatus 100 will be described below for the purpose of comparison with the operating timing of the image forming apparatus 200. FIG. 16 is a timing diagram illustrating the operation of the image forming apparatus 100. As described above, the image forming apparatus 100 includes the sheet sensor 5*b* and the water content sensor 6*b*. The water content sensor 6*b* outputs the signal corresponding to the water content of the sheet of paper P when the sheet of paper P reaches the sensing position D2 shown in FIG. 1. Accordingly, until time T1 earlier than time T2 at the time of starting the process of forming the second image on the second surface of the sheet of paper P, the signal is output from the water content sensor 6*b* and the expansion and contraction ratios δ1 and δ2 of the sheet of paper P are calculated. Accordingly, as described above, the second image to be formed on the second surface of the sheet of paper P is corrected on the basis of the calculated expansion and contraction ratios δ1 and δ2.

Figure 17:
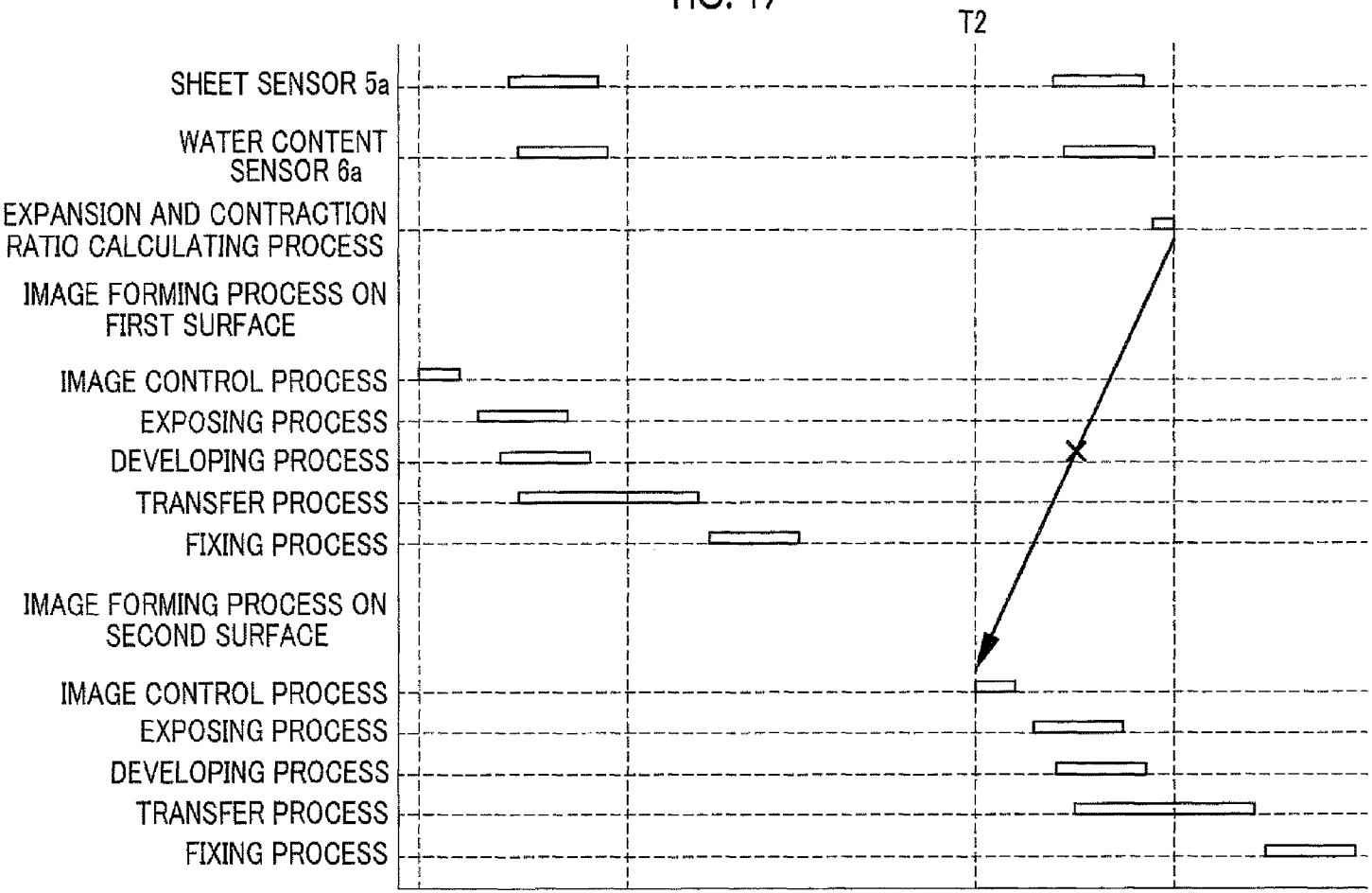
FIG. 17 is a timing diagram illustrating the behavior of the image forming apparatus according to the second exemplary embodiment.

FIG. 17 is a timing diagram illustrating the operation of the image forming apparatus 200. As described above, the image forming apparatus 200 does not include the sheet sensor 5*b* and the water content sensor 6*b*. In the image forming apparatus 200, the water content sensor 6*a* instead of the water content sensor 6*b* outputs the signal corresponding to the water content of the sheet of paper P having an image formed on the first surface thereof and being heated to fix the image. However, the water content sensor 6*a* outputs the signal corresponding to the water content of the sheet of paper P when the sheet of paper P reaches the sensing position D1 shown in FIG. 15. Accordingly, when the signal is output from the water content sensor 6*a* and the expansion and contraction ratios δ1 and δ2 of the sheet of paper P are calculated, time T2 of starting the process of forming the second image on the second surface of the sheet of paper P passes already. Therefore, in the image forming apparatus 200, the second image to be formed on the second surface of the sheet of paper P cannot be corrected on the basis of the calculated expansion and contraction ratios δ1 and δ2 of the sheet of paper P. For this reason, in the image forming apparatus 200, the expansion and contraction ratio of the sheet of paper P is calculated in advance when a test image is formed, and the calculated expansion and contraction ratio is used to form an actual image. The test image is an image used to adjust image forming conditions such as the density or the position of an image. The actual image is an image other than the test image. When the test image is formed, the same sheet of paper as used to form an actual image is used.

Figure 18:
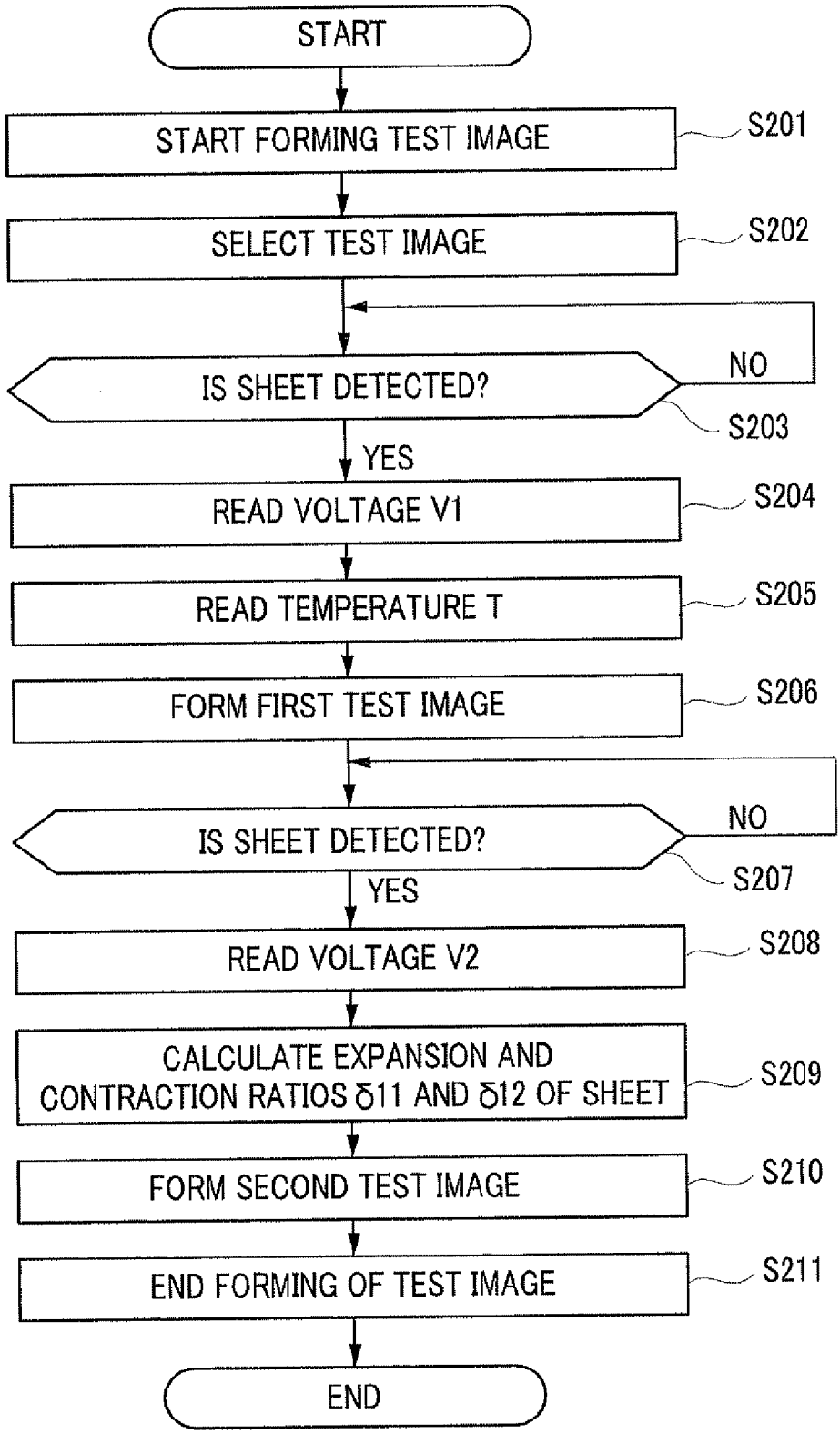
FIG. 18 is a flowchart illustrating a process of forming a test image according to the second exemplary embodiment.

FIG. 18 is a flowchart illustrating the process of forming a test image. This process is performed, for example, when an image adjusting mode is selected by a user. In step S201, the control unit 1 starts the formation of a test image. In step S202, the control unit 1 selects a test image. For example, the control unit 1 selects a test image to be used in this time out of the test image stored in the memory in advance. The processes of steps S203 to S205 are the same as the processes of steps S102 to S104. In step S206, the image forming unit 3 forms a first test image on the first surface of a sheet of paper P. Then, the image forming unit 3 heats the sheet of paper P by the use of the fixing unit 15 so as to fix the first test image. The sheet of paper P passing through the fixing unit 15 is cooled by the cooling unit 16. The sheet of paper P passing through the cooling unit 16 is turned over by the turnover unit 19 and is carried to the sensing position D1 again.

In step S207, the water content sensor 6*a* determines whether the sheet sensor 5*a* senses the sheet of paper P. This determination is repeatedly performed until the sheet sensor 5*a* senses the sheet of paper P (NO in step S207). When the sheet of paper P is carried to the sensing position D1 from the turnover unit 19, the sheet sensor 5*a* senses the sheet of paper P. When the sheet sensor 5*a* senses the sheet of paper P (YES in step S207), the water content sensor 6*a* applies light to the sheet of paper P and outputs a signal corresponding to the water content of the sheet of paper P. In step S208, the computing unit 7 acquires the signal output from the water content sensor 6*a* and reads the voltage V2 of the signal. Then, the computing unit 7 stores data representing the read voltage V2 in the memory 32.

In step S209, the computing unit 7 calculates the expansion and contraction ratios δ11 and δ12 of the sheet of paper P. The process of calculating the expansion and contraction ratios δ11 and δ12 is the same as the process of calculating the expansion and contraction ratios 81 and 62. The computing unit 7 stores the calculated expansion and contraction ratios δ11 and δ12 in the memory 32. In step S210, the image forming unit 3 forms a second test image on the second surface of the sheet of paper P. Then, the image forming unit 3 heats the sheet of paper P by the use of the fixing unit 15 so as to fix the second test image. The sheet of paper P passing through the fixing unit 15 is cooled by the cooling unit 16. The sheet of paper P passing through the cooling unit 16 is carried to the outside of the image forming apparatus 200. In step S211, the control unit 1 ends the formation of a test image.

Figure 19:
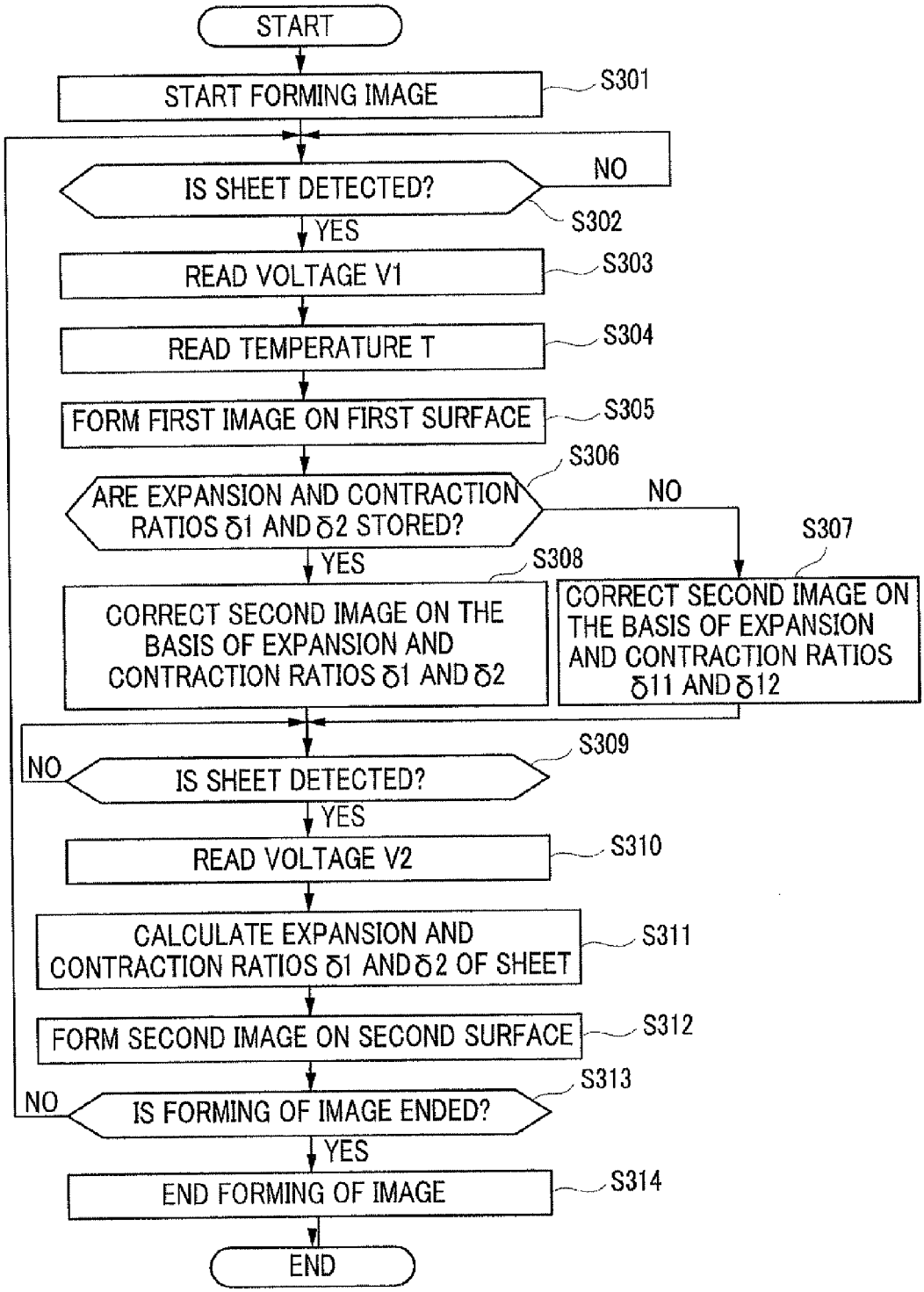
FIG. 19 is a flowchart illustrating a process of forming an actual image according to the second exemplary embodiment.

The image forming apparatus 200 forms an actual image. FIG. 19 is a flowchart illustrating the process of forming an actual image. This process is performed, for example, when a normal image forming mode is selected by a user. The processes of steps S301 to S305 are the same as the processes of steps S101 to S105.

In step S306, the computing unit 7 determines whether the expansion and contraction ratios δ1 and δ2 are stored in the memory 32. For example, when an image is formed on a first sheet of paper P, the process of calculating the expansion and contraction ratios δ1 and δ2 of the sheet of paper P is not performed yet. Accordingly, the expansion and contraction ratios δ1 and δ2 are not stored in the memory 32 (NO in step S306). In this case, the computing unit 7 performs the process of step S307. In step S307, the computing unit 7 corrects the second image represented by the second image data on the basis of the expansion and contraction ratios δ11 and δ12 stored in the memory 32. The expansion and contraction ratios δ11 and δ12 are calculated in the process of forming the test image. This correction is performed in the same way as the process of step S109. Then, the computing unit 7 performs the process of step S309.

The processes of steps S309 to S311 are the same as the processes of steps S106 to S108. Accordingly, the expansion and contraction ratios δ1 and δ2 of the sheet of paper P calculated in step S311 are stored in the memory 32. The processes of steps S312 and S313 are the same as the processes of steps S110 and S111.

In this way, when the process of forming an image on the first sheet of paper P is ended, a process of forming an image on the second sheet of paper P is started. The processes of steps S302 to S305 are the same as forming the image on the first sheet of paper P. However, when an image is formed on the second sheet of paper P or the sheets of paper subsequent thereto, the expansion and contraction ratios δ1 and δ2 calculated in step S311 are stored in the memory 32 in step S306 (YES in step S306). In this case, the computing unit 7 performs the process of step S308.

In step S308, the control unit 1 corrects the second image represented by the second image data on the basis of the expansion and contraction ratios δ1 and δ2 of the sheet of paper P stored in the memory 32. As described above, the expansion and contraction ratios δ1 and δ2 are calculated in step S311. This correction is performed in the same way as the process of step S109.

In this way, the processes of steps S302 to S313 are repeatedly performed until the formation of all images is ended. When the formation of all images is ended (YES in step S313), the control unit 1 performs the process of step S314. In step S314, the control unit 1 ends the formation of an image.

In the second exemplary embodiment, the image forming apparatus 200 does not have to be provided with plural water content sensors 6. Accordingly, it is easy to design the image forming apparatus 200, thereby reducing the manufacturing cost.

3. Modifications

The invention not limited to the above-mentioned exemplary embodiments, but may be modified in various forms.

Several modifications will be described below. The following modifications may be combined to put the invention into practice.

Modification 1

Figure 20:
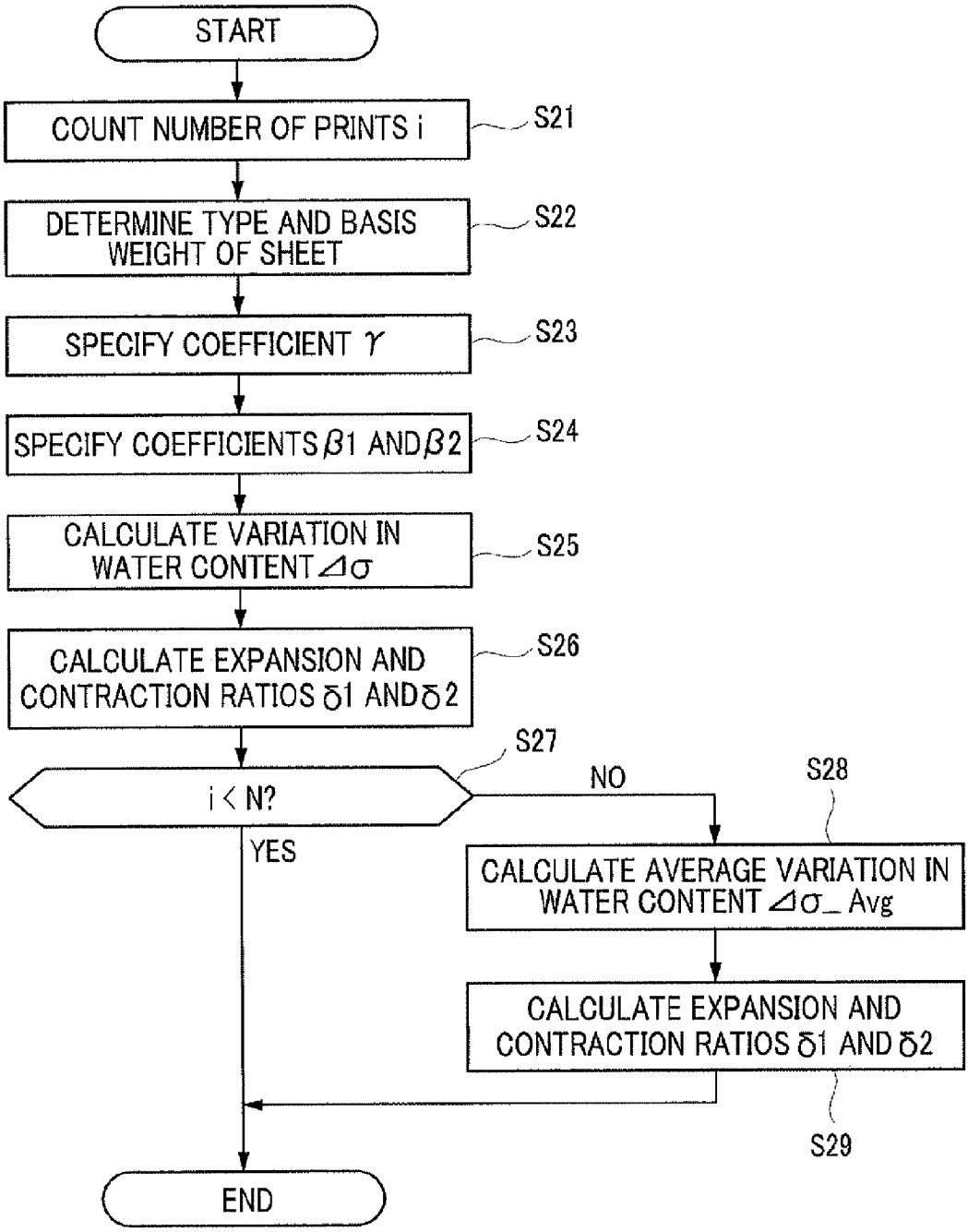
FIG. 20 is a flowchart illustrating a process of calculating an expansion and contraction ratio of a sheet of paper according to a modification.

When the expansion and contraction ratio of a sheet of paper P is calculated, an average of the variations in water content may be used. FIG. 20 is a flowchart illustrating a process of calculating an expansion and contraction ratio of a sheet of paper P according to this modification. In step S21 the computing unit 7 counts the number of prints i. For example, when an image is formed on a fifth sheet of paper P, 5 is counted as the number of prints i. The processes of steps S22 to S26 are the same as the processes of steps S11 to S15. All the variations in water content Δσ calculated in step S25 are stored in the memory 32. For example, the variation in water content Δσ calculated at the time of forming an image on a first sheet of paper P is stored as a variation in water content Δσ[1], and the variation in water content Δσ calculated at the time of forming an image on a second sheet of paper P is stored as a variation in water content ΔΓ[2].

In step S27, the computing unit 7 determines whether the number of prints i counted in step S21 is smaller than a variable N. The variable N is an integer equal to or greater than 2. When it is determined that the number of prints i counted in step S21 is smaller than the variable N (YES in step S27), the computing unit 7 ends the process. On the other hand, when the number of prints i counted in step S21 is equal to or greater than the variable N (NO in step S27), the computing unit 7 performs the process of step S28.

When the number of prints i is equal to or greater than the variable N, plural variations in water content Δσ are stored in the memory 32. In step S28, the computing unit 7 calculates the average variation in water content Δσ_Avg by the use of Expression 4 using the plural variations in water content Δσ stored in the memory 32.

$$\text{Average variation in water content } \Delta\sigma_Avg = Avg(\Delta\sigma[i-N+1] \sim \Delta\sigma[i]) \quad \text{Expression 4}$$

In step S29, the computing unit 7 calculates the expansion and contraction ratios δ1 and δ2 by the use of Expressions 5 and 6 using the average variation in water content Δσ_Avg calculated in step S28 and the coefficients β1 and β2 specified in step S24.

$$\text{Expansion and contraction ratio } \delta 1 = \Delta\sigma_Avg \times \beta 1 \quad \text{Expression 5}$$

$$\text{Expansion and contraction ratio } \delta 2 = \Delta\sigma_Avg \times \beta 2 \quad \text{Expression 6}$$

As described above, the water content sensor 6 employs 1.3 μm as the wavelength λ1 and employs 1.43 μm as the wavelength λ2. In this way, when 1.43 μm is employed as the wavelength λ2, the manufacturing cost is suppressed low but the precision of the signal output from the water content sensor 6 is lowered, compared with the case where 1.94 μm or 3.0 μm is employed as the wavelength λ2. However, in this modification, since the average variation in water content Δσ_Avg is used to calculate the expansion and contraction ratios δ1 and δ2 of the sheet of paper P, it is possible to calculate the expansion and contraction ratios δ1 and δ2 of the sheet of paper P with high precision even when the signal output from the water content sensor 6 is not uniform.

Modification 2

The characteristics of a sheet of paper are not limited to the type or the basis weight. The characteristics of a sheet of paper may be, for example, a material of the sheet of paper or a processing method thereof. The characteristics of a sheet of paper are features of the sheet of paper and preferably have an influence on the signal output from the water content sensor 6.

Modification 3

The type or the basis weight of a sheet of paper P may be determined by the control unit 1 on the basis of a feature amount of the sheet of paper P. For example, a sensor detecting a feature amount of a sheet of paper P may be disposed in the sheet feeding unit 17 and the control unit 1 may determine the type or the basis weight of the sheet of paper P on the basis of the feature amount detected by the sensor.

Modification 4

In the first exemplary embodiment, two temperature sensors 4 may be disposed. In this case, the second temperature sensor 4 is disposed around the water content sensor 6*b* and the temperature around the water content sensor 6*b*. The computing unit 7 also uses the temperature measured by the second temperature sensor 4 to calculate the variation in water content Δσ. The temperature sensor 4 is not necessarily disposed. In this case, the variation in water content Δσ is calculated using only the voltages V1 and V2 and the coefficient γ specified in step S12.

Only one of the coefficients β1 and β2 may be described in the second correction table 35. In this case, since the expansion and contraction ratios δ1 and δ2 of a sheet of paper P are equal to each other, the computing unit 7 can calculate only one of the expansion and contraction ratios δ1 and δ2. The second correction table 35 may not be necessarily disposed. Instead of the second correction table 35, only one coefficient of the coefficients β1 and β2 described in the second correction table 35 may be stored in the memory 32. In this case, the expansion and contraction ratio of the sheet of paper P is calculated using the variation in water content Δσ and the coefficient.

Modification 5

In the above-mentioned exemplary embodiments, both the size and position of an image to be formed on the second surface are corrected. However, one of the size and position of the image to be formed on the second surface may be corrected.

Modification 6

The control unit 1 instead of the computing unit 7 may implement a partial function of the computing unit 7 shown in FIG. 11. In this case, the control unit 1 and the computing unit 7 serve together as the information processor described in the above-mentioned aspect. The computing unit 7 instead of the control unit 1 may implement the function of the correction unit 46. The control unit 1 instead of the computing unit 7 may implement all the functions of the computing unit 7 shown in FIG. 11. In this case, the control unit 1 serves as the information processor described in the above-mentioned aspect.

Modification 7

The image forming apparatus 100 or 200 may form a black and white image. In this case, the image forming apparatus 100 or 200 includes only the image forming section 12K among the image forming sections 12Y, 12M, 12C, and 12K. The image forming apparatus 100 or 200 does not include the intermediate transfer belt 13.

Modification 8

The control unit 1 may include an application specific integrated circuit (ASIC). In this case, the function of the control unit 1 may be implemented by the ASIC or may be implemented by both the CPU and the ASIC. Similarly, the computing unit 7 may include an ASIC. In this case, the function of the computing unit 7 may be implemented by the ASIC or may be implemented by both the CPU and the ASIC.

Modification 9

A program implementing the function of the control unit 1 or the computing unit 7 may be provided in a state where it is stored in a computer-readable medium such as a magnetic medium (a magnetic tape, a magnetic disk (such as an HDD (Hard Disk Drive) and an FD (Flexible Disk)) an optical medium (such as an optical disk (a CD (Compact Disc), a DVD (Digital Versatile Disk), and the like), a magneto-optical medium, and a semiconductor memory and may be installed in the image forming apparatus 100 or 200. The program may be downloaded via a communication network and may be installed.

The foregoing description of the exemplary embodiments of the invention has been provided for the purpose of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention is defined by the following claims and their equivalents.

What is claimed is:

1. An information processor comprising:

a storage unit that stores a first coefficient, which is preset on the basis of the relationship between a water content of a sheet of paper and a signal output from a signal output unit on the basis of the water content when a sheet of paper having each characteristic has the water content, in correspondence with the characteristics;

a first acquisition unit that acquires a first signal output from the signal output unit on the basis of the water content of a first sheet of paper not having a first image formed thereon;

a second acquisition unit that acquires a second signal output from the signal output unit on the basis of the water content of the first sheet of paper which has the first image formed on a first surface thereof and which is heated to fix the first image;

a determination unit that determines the characteristic of the first sheet of paper;

a first calculation unit that calculates a variation in water content of the first sheet of paper using the difference between the acquired first signal and the acquired second signal and the first coefficient stored in correspondence with the determined characteristic in the storage unit; and a second calculation unit that calculates an expansion and contraction ratio of the first sheet of paper using the variation in water content calculated by the first calculation unit.

2. The information processor according to claim 1, wherein the storage unit stores a second coefficient, which is preset on the basis of the relationship between the variation in water content of a sheet of paper and the expansion and contraction ratio of the sheet of paper when the water content of a sheet of paper having characteristics varies by the variation, in correspondence with the characteristics, and wherein the second calculation unit calculates the expansion and contraction ratio of the first sheet of paper using the second coefficient stored in correspondence with the determined characteristic in the storage unit.

3. The information processor according to claim 2, wherein the second coefficient includes a coefficient regarding the expansion and contraction ratio in a first direction of a sheet of paper and a coefficient regarding the expansion and contraction ratio in a second direction of the sheet of paper.

4. The information processor according to claim 1, wherein the storage unit stores the variation in water content calculated by the first calculation unit, and wherein the second calculation unit calculates the expansion and contraction ratio of the first sheet of paper using an average of the variation in water content stored in the storage unit.

5. The information processor according to claim 2, wherein the storage unit stores the variation in water content calculated by the first calculation unit, and wherein the second calculation unit calculates the expansion and contraction ratio of the first sheet of paper using an average of the variation in water content stored in the storage unit.

6. The information processor according to claim 3, wherein the storage unit stores the variation in water content calculated by the first calculation unit, and wherein the second calculation unit calculates the expansion and contraction ratio of the first sheet of paper using an average of the variation in water content stored in the storage unit.

7. The information processor according to claim 1, further comprising a measuring unit that measures a temperature around the signal output unit, wherein the first calculation unit calculates the variation in water content of the first sheet of paper using the temperature measured by the measuring unit.

8. The information processor according to claim 2, further comprising a measuring unit that measures a temperature around the signal output unit, wherein the first calculation unit calculates the variation in water content of the first sheet of paper using the temperature measured by the measuring unit.

9. The information processor according to claim 3, further comprising a measuring unit that measures a temperature around the signal output unit, wherein the first calculation unit calculates the variation in water content of the first sheet of paper using the temperature measured by the measuring unit.

10. The information processor according to claim 4, further comprising a measuring unit that measures a temperature around the signal output unit, wherein the first calculation unit calculates the variation in water content of the first sheet of paper using the temperature measured by the measuring unit.

11. The information processor according to claim 5, further comprising a measuring unit that measures a temperature around the signal output unit, wherein the first calculation unit calculates the variation in water content of the first sheet of paper using the temperature measured by the measuring unit.

12. The information processor according to claim 6, further comprising a measuring unit that measures a temperature around the signal output unit, wherein the first calculation unit calculates the variation in water content of the first sheet of paper using the temperature measured by the measuring unit.

13. An image forming apparatus comprising:

a signal output unit that outputs a first signal corresponding to the water content of the first sheet of paper not having a first image formed thereon and a second signal corresponding to the water content of the first sheet of paper which has the first image formed on a first surface thereof and which is heated to fix the first image;

a storage unit that stores a first coefficient, which is preset on the basis of the relationship between a water content of a sheet of paper and a signal output from the signal output unit on the basis of the water content when a sheet of paper having each characteristic has the water content, in correspondence with the characteristics;

a first acquisition unit that acquires the first signal output from the signal output unit;

a second acquisition unit that acquires the second signal output from the signal output unit;

a determination unit that determines the characteristic of the first sheet of paper;

a first calculation unit that calculates a variation in water content of the first sheet of paper using the difference between the acquired first signal and the acquired second signal and the first coefficient stored in correspondence with the determined characteristic in the storage unit;

a second calculation unit that calculates an expansion and contraction ratio of the first sheet of paper using the variation in water content calculated by the first calculation unit;

a correction unit that either corrects the size or position of a second image formed on a second surface of the first sheet of paper on the basis of the expansion and contraction ratio calculated by the second calculation unit, or corrects an image to be formed on a second surface of a second sheet of paper; and an image forming unit that forms the first image on the first surface of the first sheet of paper, heats the first sheet of paper to fix the first image, and forms the corrected second image on the second surface of the first sheet of paper.

14. The image forming apparatus according to claim 13, wherein the signal output unit outputs the first signal and the second signal through the use of a single device, wherein the correction unit corrects an image to be formed on a second surface of a second sheet of paper, and wherein the image forming unit forms the corrected image on the second surface of the second sheet of paper after forming an image on the first sheet of paper.

15. The image forming apparatus according to claim 14, wherein the image forming unit forms an image in accordance with an image forming condition, wherein the image formed on the first sheet of paper is a test image used to adjust the image forming condition, and wherein the image formed on the second sheet of paper is an image other than the test image.

16. An information processing method in an information processor having a storage unit that stores a first coefficient, which is preset on the basis of the relationship between a water content of a sheet of paper and a signal output from a signal output unit on the basis of the water content when a sheet of paper having each characteristic has the water content, in correspondence with the characteristics, the method comprising;

acquiring a first signal output from the signal output unit on the basis of the water content of a first sheet of paper not having a first image formed thereon;

acquiring a second signal output from, the signal output unit on the basis of the water content of the first sheet of paper which has the first image formed on a first surface thereof and which is heated to fix the first image;

determining the characteristic of the first sheet of paper;

calculating a variation in water content of the first sheet of paper using the difference between the acquired first signal and the acquired second signal and the first coefficient stored in correspondence with the determined characteristic in the storage unit; and calculating an expansion and contraction ratio of the first sheet of paper using the variation in water content calculated by the first calculation unit.

17. A non-transitory computer-readable medium storing a program causing a computer to execute a process, the computer including a storage unit that stores a first coefficient, which is preset on the basis of the relationship between a water content of a sheet of paper and a signal output from a signal output unit on the basis of the water content when a sheet of paper having each characteristic has the water content, in correspondence with the characteristics, the process comprising:

acquiring a first signal output from the signal output unit on the basis of the water content of a first sheet of paper not having a first image formed thereon;

acquiring a second signal output from the signal output unit on the basis of the water content of the first sheet of paper which has the first image formed on a first surface thereof and which is heated to fix the first image;

determining the characteristic of the first sheet of paper;

calculating a variation in water content of the first sheet of paper using the difference between the acquired first signal and the acquired second signal and the first coefficient stored in correspondence with the determined characteristic in the storage unit; and calculating an expansion and contraction ratio of the first sheet of paper using the calculated variation in water content.

* * * * *